US007101013B2

(12) United States Patent
Nakamura

(10) Patent No.: US 7,101,013 B2
(45) Date of Patent: Sep. 5, 2006

(54) METHOD OF DETERMINING ABNORMALITY OF NOZZLES IN IMAGING APPARATUS; IMAGING APPARATUS; ELECTROOPTIC DEVICE; METHOD OF MANUFACTURING ELECTROOPTIC DEVICE; AND ELECTRONIC EQUIPMENT

(75) Inventor: Shinichi Nakamura, Okaya (JP)

(73) Assignee: Seiko Epson Corporation, (JP)

( * ) Notice: Subject to any disclaimer, the term of this patent is extended or adjusted under 35 U.S.C. 154(b) by 160 days.

(21) Appl. No.: 10/705,814

(22) Filed: Nov. 10, 2003

(65) Prior Publication Data

US 2004/0169693 A1 Sep. 2, 2004

(30) Foreign Application Priority Data

Nov. 12, 2002 (JP) ..... 2002-328795
Jul. 31, 2003 (JP) ..... 2003-204393

(51) Int. Cl.
*B41J 29/393* (2006.01)

(52) U.S. Cl. ..... 347/19; 347/30

(58) Field of Classification Search ..... 347/19, 347/23, 30–35

See application file for complete search history.

(56) References Cited

U.S. PATENT DOCUMENTS

| | | | | |
|---|---|---|---|---|
| 6,480,182 | B1 * | 11/2002 | Turner et al. | 345/107 |
| 6,565,185 | B1 * | 5/2003 | Endo | 347/23 |
| 6,783,208 | B1 * | 8/2004 | Kawase et al. | 347/41 |
| 2002/0085057 | A1 * | 7/2002 | Endo | 347/19 |
| 2002/0171699 | A1 * | 11/2002 | Choi | 347/19 |

FOREIGN PATENT DOCUMENTS

| | | |
|---|---|---|
| JP | 08-118679 | 5/1996 |
| JP | 09-024607 | 1/1997 |
| JP | 09-101410 | 4/1997 |
| JP | 2000-190469 | 7/2000 |
| JP | 2001/315351 | 11/2001 |
| JP | 2002/001935 | 1/2002 |
| JP | 2002/187293 | 7/2002 |
| JP | 2002-273869 | 9/2002 |
| WO | WO 01/87627 | 11/2001 |

OTHER PUBLICATIONS

Communication from Korean Patent Office regarding related application.

Aug. 2, 2005 Communication from Japanese Patent Office regarding corresponding Japanese Patent Application No. 2003-204393.

* cited by examiner

*Primary Examiner*—Lamson Nguyen
(74) *Attorney, Agent, or Firm*—Harness, Dickey & Pierce, P.L.C.

(57) ABSTRACT

In an imaging apparatus having a head unit mounting thereon liquid droplet ejection heads with a plurality of ejection nozzles, a confirmation is made before starting an imaging operation as to whether or not liquid droplets are normally ejected from the respective ejection nozzles. This confirmation is made by using optical liquid droplet detectors having a light emitting element and a light receiving element. When ejection of liquid droplets from any of the ejection nozzles of liquid droplet ejection heads is determined to be abnormal in an ejection confirming operation, the ejection confirming operation is performed again. When the ejection of the liquid droplets from the same ejection nozzle is determined to be abnormal also in this ejection confirming operation, this ejection nozzle is judged to be abnormal.

8 Claims, 33 Drawing Sheets

METHOD OF DETERMINING ABNORMALITY OF NOZZLES IN IMAGING APPARATUS; IMAGING APPARATUS; ELECTROOPTIC DEVICE; METHOD OF MANUFACTURING ELECTROOPTIC DEVICE; AND ELECTRONIC EQUIPMENT

BACKGROUND OF THE INVENTION

1. Field of the Invention

This invention relates to a method of determining abnormality of nozzles in an imaging (drawing) device using a liquid droplet ejection (or discharge) head having a plurality of ejection (or discharge) nozzles as represented by an ink jet head; an imaging apparatus; an electrooptic device; a method of manufacturing the electrooptic device; and an electronic equipment.

2. Description of the Related Art

An ink jet head (a liquid droplet ejection head) of an ink jet printer can accurately eject dot-shaped minute ink droplets (liquid droplets). Thus, by using a function liquid (hereinafter referred to as function liquid) such as a particular ink or photosensitive resin, for example, as an ejected liquid, the ink jet head is expected to be applied to a field of manufacturing of various devices.

For example, it is considered to manufacture a color filter of a liquid crystal display, an organic electroluminescence (EL) display and the like by using a head unit including a plurality of liquid droplet ejection heads. Specifically, the color filter is manufactured by ejecting function liquid toward a workpiece, such as a substrate of the color filter, from respective ejection nozzles of the respective liquid droplet ejection heads while moving the head unit relatively to the workpiece in two scanning directions orthogonal to each other.

Here, if an imaging operation is halted for a certain amount of time to perform loading/unloading of the workpiece and the like, clogging of the ejection nozzles may be caused by increased viscosity of the function liquid of the liquid droplet ejection heads. Thus, it is desired to dispose maintenance means for the liquid droplet ejection heads in an imaging apparatus and to perform maintenance operations, such as a preliminary ejection for ejecting the function liquid from the ejection nozzles and removal of the function liquid from the ejection nozzles by suction, by moving the head unit to a position where the maintenance means is disposed during the pause.

Moreover, in order to prevent defective products, it is also desired to confirm whether or not the function liquid is normally ejected from the respective ejection nozzles before starting the imaging operation after the maintenance operation.

Regarding a regular ink jet printer including no maintenance means, liquid droplet detection means is conventionally known, which includes an emitting element and a light receiving element and detects ejection of a function liquid based on a change in an amount of light received when the function liquid crosses an optical path between the two elements.

Also in the foregoing imaging apparatus, it is considered that, by using the liquid droplet detection means as described above, an ejection confirming operation for the function liquid is performed to determine whether or not the function liquid is normally ejected from the respective ejection nozzles.

Moreover, regarding the regular ink jet printer, there is conventionally known a technology of performing a printing operation by using only a part of a nozzle array including continuously arranged normal ejection nozzles when any of the ejection nozzles are determined to be abnormal.

When the ejection confirming operation for the function liquid is performed by using such optical liquid droplet detection means as that of the foregoing conventional example, which includes the emitting element and the light receiving element, an erroneous determination is sometimes made. Specifically, even if the function liquid is normally ejected from the ejection nozzles, a determination of abnormal ejection is made, that is, the ejection nozzles may be determined to be abnormal due to satellite (floating misty particles resulting from an ejected liquid), electrical noise and the like.

Moreover, if an imaging operation is performed by using only a part of the nozzle array including the continuously arranged normal ejection nozzles, as described in the foregoing conventional example, when any of the ejection nozzles are abnormal, the operation takes long and efficiency is lowered. Here, even if the function liquid is not normally ejected, execution of the maintenance operation, such as the preliminary ejection of ejecting the function liquid from the ejection nozzles, may sometimes restore a state where the function liquid is normally ejected.

SUMMARY OF THE INVENTION.

In consideration of the foregoing circumstances, it is an advantage of this invention to provide a method of determining abnormality of nozzles in an imaging apparatus, the imaging apparatus, an electrooptic device, a method of manufacturing the electrooptic device and electronic equipment. Specifically, the method of determining abnormality of nozzles in an imaging apparatus is capable of preventing an erroneous determination as much as possible and performing an imaging operation efficiently by restoring ejection nozzles when the ejection nozzles are determined to be abnormal.

In order to achieve the foregoing advantage, there is provided a method of determining abnormality of nozzles in an imaging apparatus having a plurality of ejection nozzles, comprising: a first step of performing a function liquid droplet ejection confirming operation to determine whether or not function liquid droplets are normally ejected from the respective ejection nozzles by using liquid droplet detection means before performing the imaging operation; a second step of performing the function liquid droplet ejection confirming operation once again when the ejection of the function liquid droplets from any of the ejection nozzles is determined to be abnormal in the first step; and a third step of judging the ejection nozzle to be abnormal when the ejection of the function liquid droplets from an identical ejection nozzle is determined to be abnormal also in the second step.

According to the above-described arrangement, only when the ejection of the function liquid droplets from the identical (the same) ejection nozzle is determined to be abnormal twice in succession, the ejection nozzle is determined to be abnormal. Even if the liquid droplet detection means is affected by satellite, electrical noises and the like, as long as the ejection nozzles are normal, it is less likely that the ejection of the function liquid droplets is determined to be abnormal twice in succession. Therefore, an erroneous determination in which the normal ejection nozzles are determined to be abnormal is prevented to the best extent possible.

Preferably, the method further comprises: a fourth step of performing a maintenance work when any of the ejection nozzles is judged to be abnormal, thereby restoring the ejection nozzles to a state in which the function liquid droplets are ejected normally; a fifth step of performing the function liquid droplet ejection confirming operation once again after the fourth step; and a sixth step of transferring to the imaging work when the function liquid droplets are determined to be ejected normally from all of the ejection nozzles in the fifth step.

Here, the abnormal ejection of the function liquid droplets is likely to be caused by minor clogging in the vicinity of the ejection nozzles. A preliminary ejection in which the function liquid droplets are ejected from the ejection nozzles is likely to restore a state in which the function liquid droplets are normally ejected. Since the preliminary ejection requires a short amount of time, the foregoing maintenance operation is preferably the preliminary ejection.

Moreover, even if there occurs severe clogging that cannot be repaired by the preliminary ejection, removal of the function liquid droplets from the ejection nozzles by suction may restore the state where the function liquid droplets are normally ejected.

Therefore, the method preferably further comprises: a seventh step of performing the function liquid droplet ejection confirming operation once again after a second maintenance work to remove the function liquid droplets from the ejection nozzles when the function liquid droplet ejection is determined to be abnormal also in the fifth step; and an eighth step of issuing an instruction of replacing the head unit when the ejection of the function liquid droplets is determined to be abnormal even after the seventh step.

The imaging apparatus according to this invention is a device in which the above-described method of determining abnormality of nozzles is executed.

According to the above-described arrangement, the ejection of the function liquid droplets can be confirmed efficiently after the maintenance work.

The electrooptic device according to this invention is a device having formed a film formation part by ejecting the function liquid droplets onto the workpiece from the liquid droplet ejection heads with the above-described imaging apparatus.

The method of manufacturing the electrooptic device according to this invention comprises the step of forming a film formation part by ejecting the function liquid droplets onto the workpiece from the liquid droplet ejection heads with the above-described imaging apparatus.

According to the above-described arrangements, the electrooptic device is manufactured by using the reliable imaging apparatus without abnormal ejection of the function liquid droplets and thus the electrooptic device itself can be manufactured efficiently. As the electrooptic device, a liquid crystal display, an organic electroluminescence (EL) device, an electron-emitting device, a plasma display panel (PDP) device, an electrophoretic display and the like are conceivable. The electron-emitting device conceptually includes so-called field emission display (FED) and surface-conduction electron-emitter display (SED) devices. Furthermore, as the electrooptic device, conceivable are devices for forming a metallic wiring, a lens, a resist, a light diffusion body and the like.

The electronic equipment according to this invention is characterized in that the foregoing electrooptic device or an electrooptic device manufactured by the method of manufacturing an electrooptic device is mounted thereon.

In this case, as the electronic equipment, a portable telephone equipped with a so-called flat panel display, a personal computer and various other electrical appliances are applicable.

BRIEF DESCRIPTION OF THE DRAWINGS

The above and other features of this invention will become readily apparent by reference to the following detailed description when considered in conjunction with the accompanying drawings wherein.

DETAILED DESCRIPTION OF THE PREFERRED EMBODIMENTS

Figure 1:
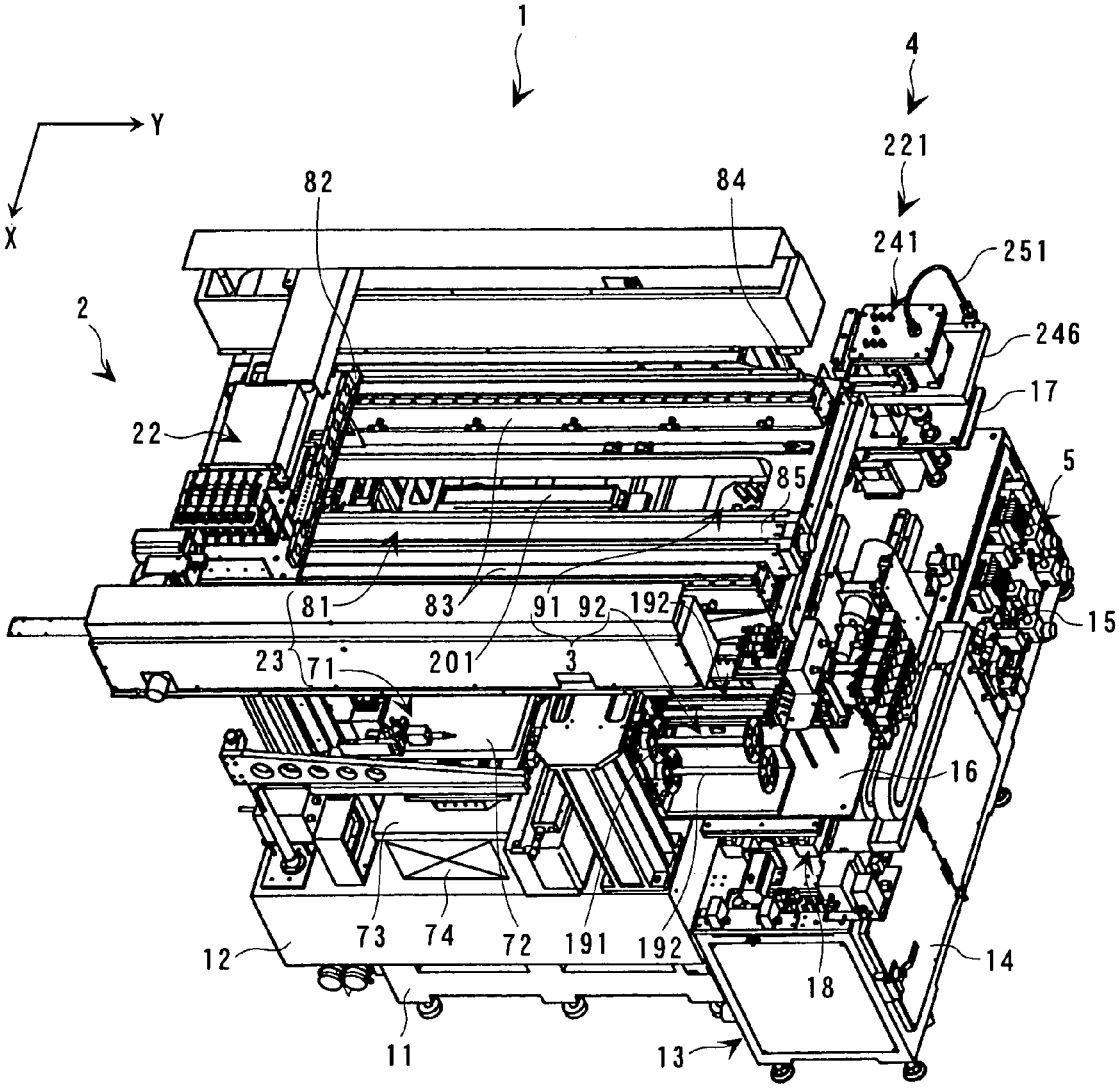
FIG. 1 is an external perspective view of an imaging apparatus according to an embodiment of this invention.
Figure 2:
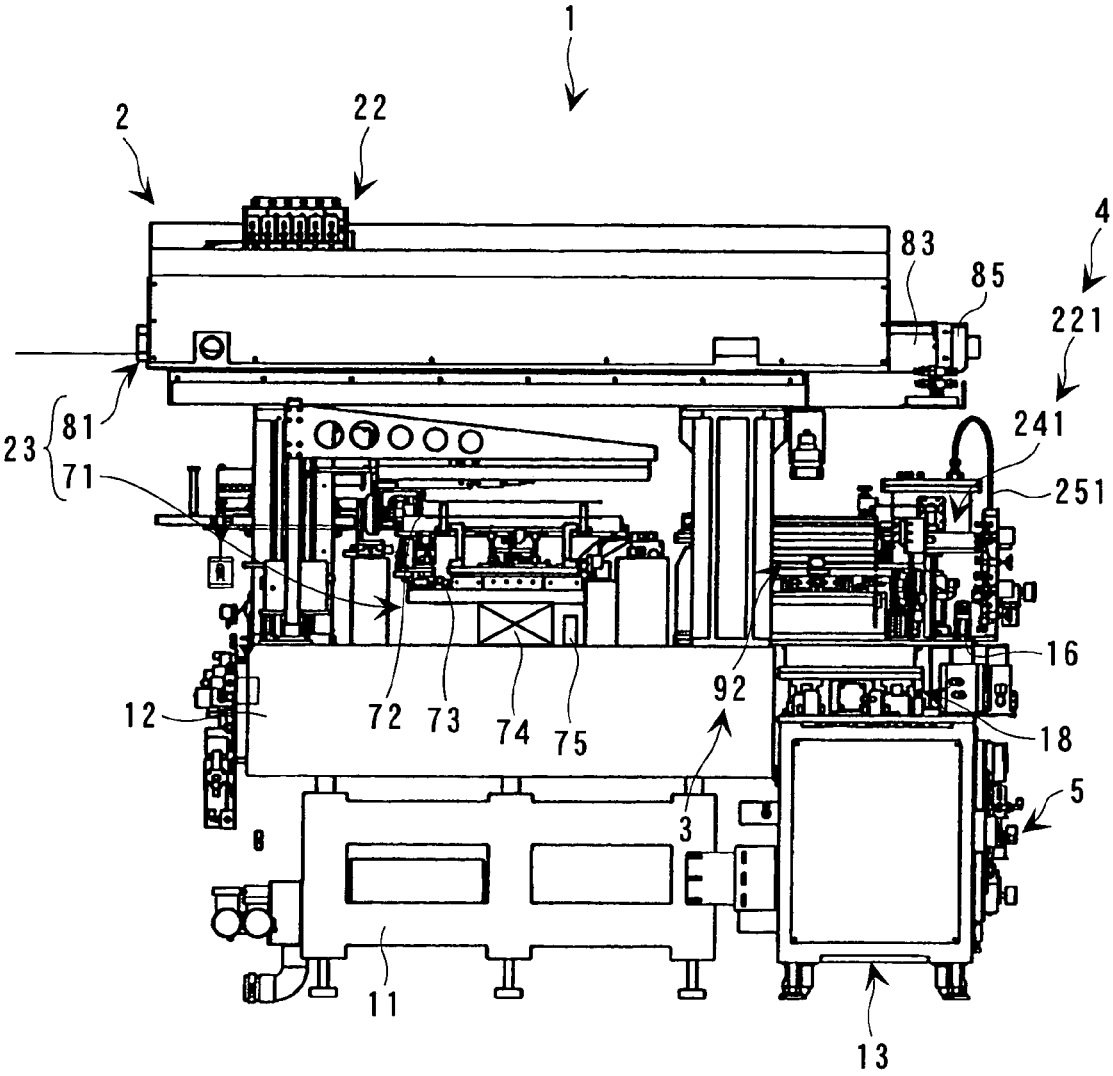
FIG. 2 is a front view thereof.
Figure 3:
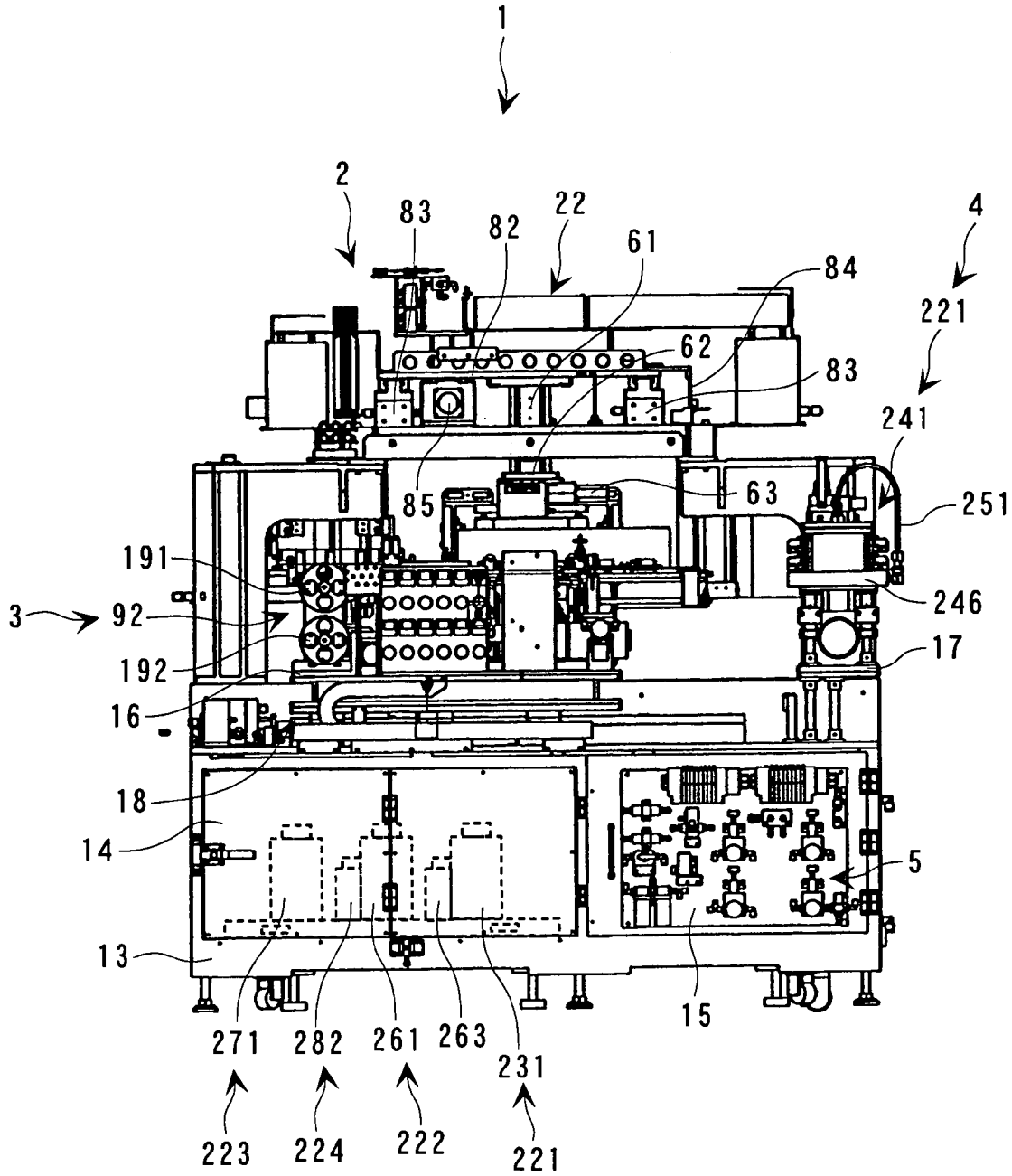
FIG. 3 is a right side view thereof.
Figure 4:
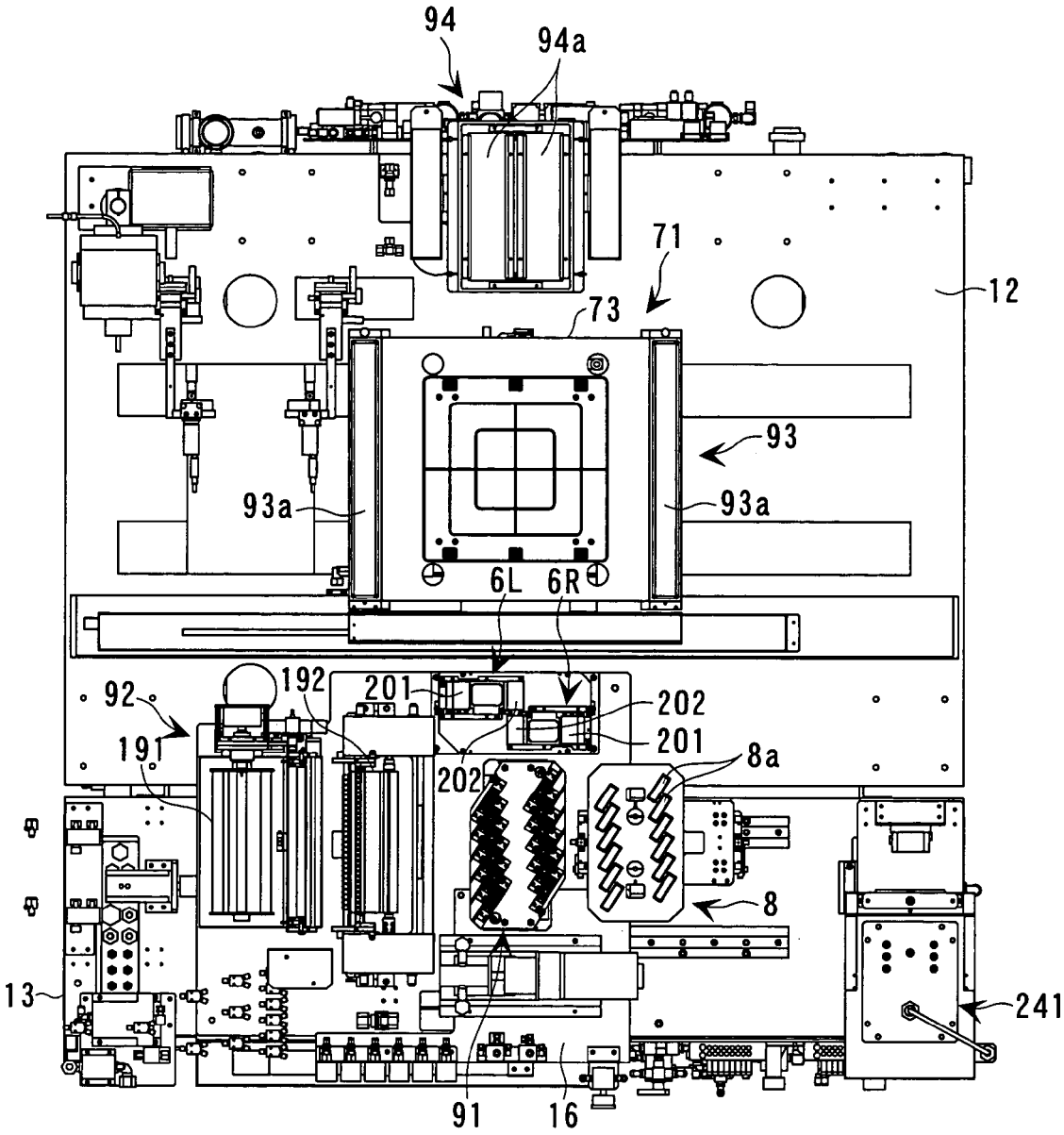
FIG. 4 is a partial plan view thereof.

With reference to the accompanying drawings, an embodiment of this invention will be described below. FIG. 1 is an external perspective view of an imaging apparatus to which this invention is applied. FIGS. 2 to 4 are front view, right side view and partial plan view of the imaging apparatus to which this invention is applied. As described later in detail, this imaging apparatus 1 is configured to form a film formation part of a liquid droplet on a workpiece W such as a substrate by introducing a function liquid such as a particular ink and a luminescent resin liquid into a liquid droplet ejection head 31.

As shown in FIGS. 1 to 4, the imaging apparatus 1 includes: imaging means 2 for ejecting the function liquid while moving the liquid droplet ejection head 31 relatively to the workpiece W; maintenance means 3 for performing maintenance of the liquid droplet ejection head 31; function liquid supply/recovery means 4 for supplying the liquid droplet ejection head 31 with the function liquid and recovering the unnecessary function liquid; air supply means 5 for supplying compressed air for driving and controlling the respective means; and liquid droplet detection means 6L and 6R for detecting ejection of liquid droplets from the liquid droplet ejection head 31. The respective means described above are controlled while being correlated with each other by control means 7. Besides the above-described means, a workpiece recognition camera for recognizing a position of the workpiece W, a head recognition camera for confirming a position of a head unit 21 (to be described later) of the imaging means 2 and accessory devices such as various indicators are provided in the imaging apparatus, all of which are omitted from the drawings. These devices are also controlled by the control means 7.

As shown in FIGS. 1 to 4, the imaging means 2 is disposed on a stone surface plate 12 fixed to a frame 11 constructed by assembling angle members into a rectangle and large parts of the function liquid supply/recovery means 4 and the air supply means 5 are built in a machine stage 13 added to the frame 11. In the machine stage 13, two large and small housing chambers 14 and 15 are formed. Tanks of the function liquid supply/recovery means 4 are housed in the large housing chamber 14 and a main part of the air supply means 5 is housed in the small housing chamber 15. Moreover, on the machine stage 13, a tank base 17 on which a liquid supply tank 241 of the function liquid supply/recovery means 4 is placed and a movable table 18 supported as freely slidable in a longitudinal direction of the machine stage 13 (that is an X-axis direction) are provided, both of which will be described later. To the movable table 18, a common base 16 is fixed, on which a suction unit 91 (to be described later) of the maintenance means 3 and a wiping unit 92 (to be described later) thereof are placed.

This imaging apparatus 1 is arranged to supply the liquid droplet ejection head 31 with the function liquid from the liquid supply tank 241 of the function liquid supply/recovery means 4 and to eject the function liquid onto the workpiece W from the liquid droplet ejection head 31, while maintaining the liquid droplet ejection head 31 of the imaging means 2 by the maintenance means 3. The respective means will be described below.

The imaging means 2 includes: a head unit 21 having a plurality of the liquid droplet ejection heads 31 which eject the function liquid; a main carriage 22 which supports the head unit 21; and an X/Y moving mechanism 23 which moves the head unit 21 relative to the workpiece W in two scanning directions including a main-scanning direction (the X-axis direction) and a sub-scanning direction orthogonal thereto (a Y-axis direction).

Figure 5:
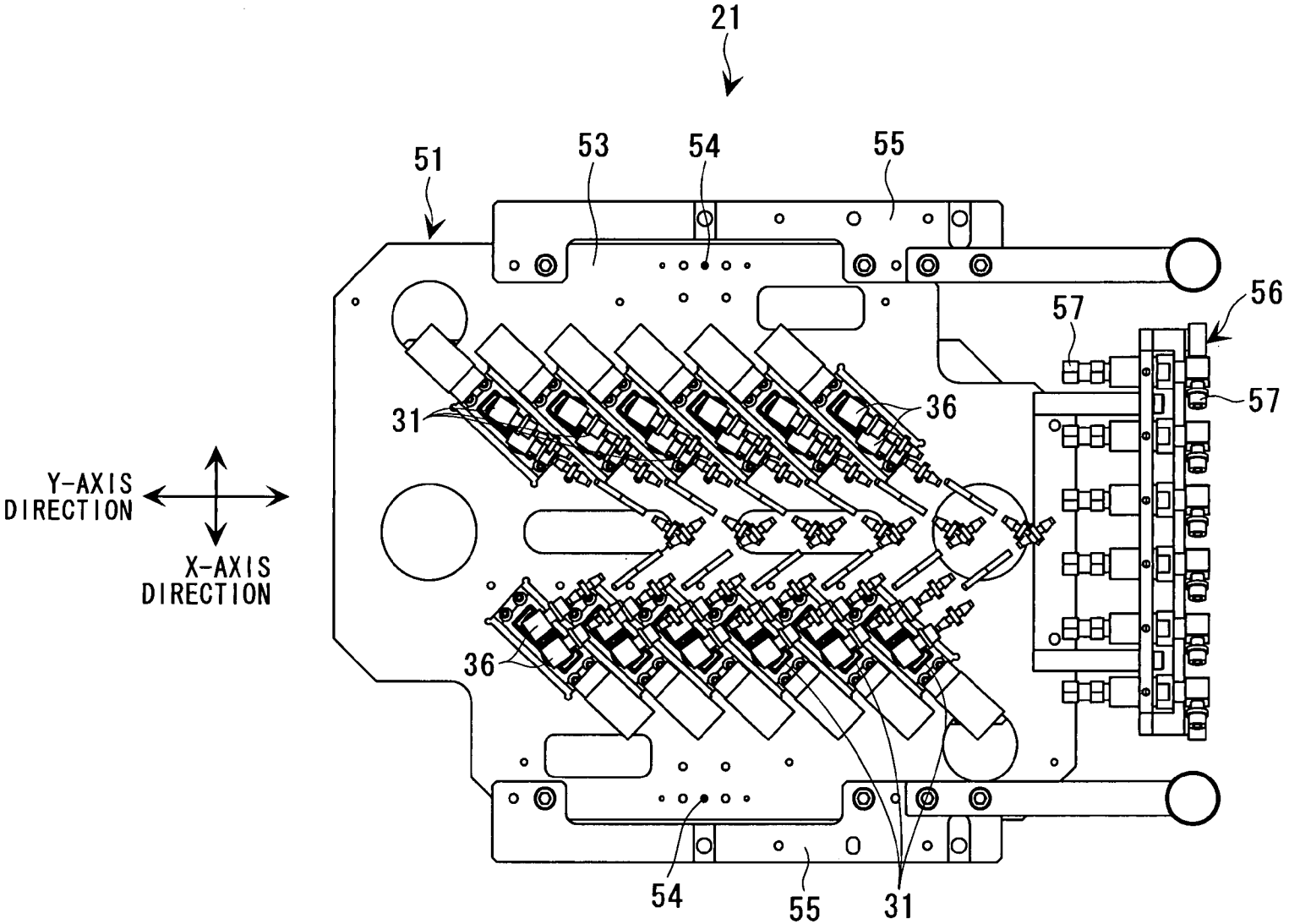
FIG. 5 is a plan view of a head unit according to the embodiment.
Figure 6A:
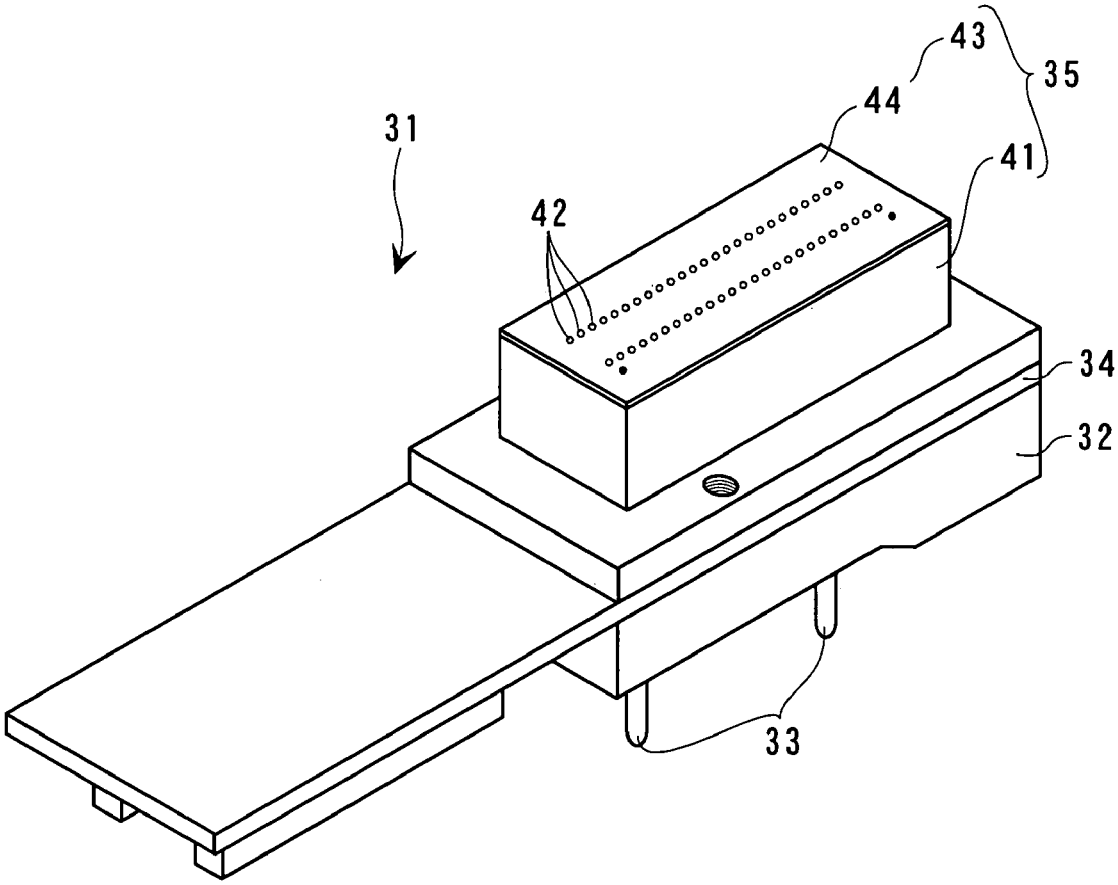
FIG. 6A is a perspective view of a liquid droplet ejection head according to the embodiment and FIG. 6B is a cross-sectional view of a main part thereof.
Figure 6B:
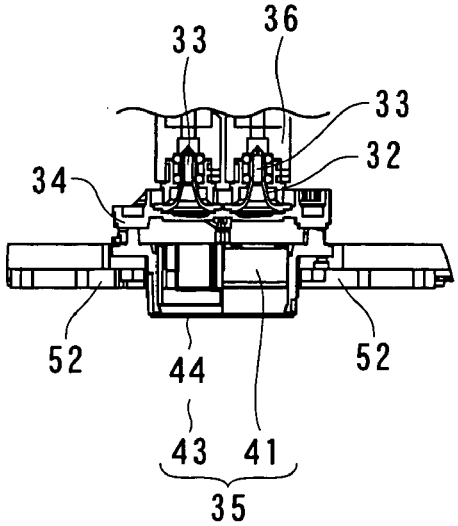

As shown in FIG. 5 and FIGS. 6A and 6B, the head unit 21 includes: the plurality of (twelve) liquid droplet ejection heads 31; a sub-carriage 51 loading the plurality of liquid droplet ejection heads 31 thereon; and a head holding member 52 for attaching the liquid droplet ejection heads 31 to the sub-carriage 51 by allowing a nozzle forming surface 44 (a nozzle surface) of each of the liquid droplet ejection heads 31 to protrude downward. On the sub-carriage 51, the twelve liquid droplet ejection heads 31 are disposed while being divided into two rows, each row having six thereof, in the main-scanning direction (the X-axis direction) with a space between the two rows. Moreover, the respective liquid droplet ejection heads 31 are disposed on the sub-carriage 51 while being tilted at a predetermined angle in order to secure a sufficient application density of the function liquid to the workpiece W. Furthermore, one row of the liquid droplet ejection heads 31 and the other row thereof are disposed while being shifted from each other in the sub-scanning direction (the Y-axis direction) and thus ejection nozzles 42 of the respective liquid ejection heads 31 are continuously aligned (partially overlapped) in the sub-scanning direction. When the sufficient application density of the function liquid to the workpiece W can be secured by forming the liquid droplet ejection heads 31 by using dedicated components, the liquid droplet ejection heads 31 do not have to be tilted in setting thereof.

As shown in FIGS. 6A and 6B, the liquid droplet ejection head 31 includes: a so-called twin function liquid introduction part 32 having twin connection needles 33; a twin head substrate 34 connected to the function liquid introduction part 32; and a head main body 35 which is connected to the lower portion of the function liquid introduction part 32 and has an inner passage formed therein, the inner passage being filled with the function liquid. Each of the connection needles 33 is connected to the liquid supply tank 241 of the function liquid supply/recovery means 4 through a piping adaptor 36. Thus, the function liquid introduction part 32 receives a supply of the function liquid from each connection needle 33. The head main body 35 includes a twin pump part 41 and a nozzle forming plate 43 having the nozzle forming surface 44 on which a number of ejection nozzles 42 are formed. In the liquid droplet ejection head 31, a liquid droplet is ejected from the ejection nozzles 42 by an action of the pump part 41. On the nozzle forming surface 44, two ejection nozzle 42 arrays including the number of ejection nozzles 42 are formed.

As shown in FIG. 5, the sub-carriage 51 includes: a partially notched main body plate 53; a pair of left and right reference pins 54 provided at intermediate positions in a long side direction of the main body plate 53; and a pair of left and right supporting members 55 attached to both of long side portions of the main body plate 53. The pair of reference pins 54 become the reference for positioning (positional recognition) of the sub-carriage 51 (the head unit 21) in the X-axis, Y-axis and θ-axis directions on the premise of image recognition. The supporting members 55 become fixation areas in fixing the head unit 21 to the main carriage 22. Moreover, in the sub-carriage 51, a piping joint 56 is provided to connect the respective liquid droplet ejection heads 31 with the liquid supply tank 241 through piping. The piping joint 56 includes twelve sockets 57 for connecting head side piping members from the piping adaptors 36 connected to (the connection needles 33 of) the respective liquid droplet ejection heads 31 with one ends thereof and for connecting device side piping members from the liquid supply tank 241 with the other ends thereof.

As shown in FIG. 3, the main carriage 22 includes: a hanging member 61 having an "I"-shaped appearance, which is fixed from a lower side by a bridge plate 82 to be described later; a θ table 62 attached to a lower surface of the hanging member 61; and a carriage main body 63 attached to the θ table so as to be hung therebelow. The carriage main body 63 has a rectangular aperture for loosely fitting the head unit 21 and positions and fixes the head unit 21.

As shown in FIGS. 1 to 3, the X/Y moving mechanism 23, which is fixed to the above-described stone surface plate 12, moves the workpiece W in the main-scanning direction (the X-axis direction) and moves the head unit 21 in the sub-scanning direction (the Y-axis direction) through the main carriage 22. The X/Y moving mechanism 23 includes: an X-axis table 71 fixed by allowing its axis line to coincide with a center line along a long side of the stone surface plate 12; and a Y-axis table 81 of which axis line coincides with a center line along a short side of the stone surface plate 12 while crossing the X-axis table 71.

The X-axis table 71 includes: a suction table 72 which sets the workpiece W thereon by air suction; a θ table 73 which supports the suction table 72; an X-axis air slider 74 which supports the θ table 73 to be freely slidable in the X-axis direction; an X-axis linear motor (not illustrated) which moves the workpiece W on the suction table 72 in the X-axis direction through the θ table 73; and an X-axis linear scale 75 placed side by side with the X-axis air slider 74. The main scanning of the liquid droplet ejection heads 31 is performed in such a manner that drive of the X-axis linear motor moves the suction table 72 having the workpiece W sucked thereon and the θ table 73 back and forth in the X-axis direction by using the X-axis air slider 74 as a guide.

The Y-axis table 81 includes: a bridge plate 82 which hangs the main carriage 22; a pair of Y-axis sliders 83 which support the bridge plate 82 at two points so as to be slidable in the Y-axis direction; a Y-axis linear scale 84 placed side by side with the Y-axis sliders 83; a Y-axis ball screw 85 which moves the bridge plate 82 in the Y-axis direction by using the pair of Y-axis sliders 83 as a guide; and a Y-axis motor (not illustrated) which rotates the Y-axis ball screw 85 in forward and backward directions. The Y-axis motor includes a servo motor and, when the Y-axis motor is rotated in the forward and backward directions, the bridge plate 82 screwed thereto through the Y-axis ball screw 85 is moved in the Y-axis direction while being guided by the pair of Y-axis sliders 83. Specifically, along with the movement of the bridge plate 82, the main carriage 22 (the head unit 21) moves back and forth in the Y-axis direction and thus the sub-scanning of the liquid droplet ejection heads 31 is performed. Note that the Y-axis table 81 and the θ table 73 are omitted in FIG. 4.

Here, a series of operations of the imaging means 2 will be briefly described. First, as a preparation prior to an imaging operation of ejecting the function liquid toward the workpiece W, a position of the head unit 21 is corrected by the head recognition camera and, thereafter, a position of the workpiece W set on the suction table 72 is corrected by the workpiece recognition camera. Next, an operation of selectively ejecting liquid droplets onto the workpiece W is performed by moving the workpiece W back and forth in the main scanning (the X-axis) direction by the X-axis table 71 and driving the plurality of liquid droplet ejection heads 31. Subsequently, after moving the workpiece W back and forth, the head unit 21 is moved in the sub-scanning (the Y-axis) direction by the Y-axis table 81. Accordingly, the back-and-forth movement of the workpiece W in the main scanning direction and the drive of the liquid droplet ejection heads 31 are performed again. Note that, in this embodiment, the workpiece W is moved in the main scanning direction with respect to the head unit 21. However, the head unit 21 may be moved in the main scanning direction. Moreover, the head unit 21 may be moved in the main-scanning and sub-scanning directions while fixing the workpiece W.

Next, the maintenance means 3 will be described. The maintenance means 3 maintains the liquid droplet ejection heads 31 so that the liquid droplet ejection heads 31 can properly eject the function liquid and includes the suction unit 91 and the wiping unit 92.

Figure 7:
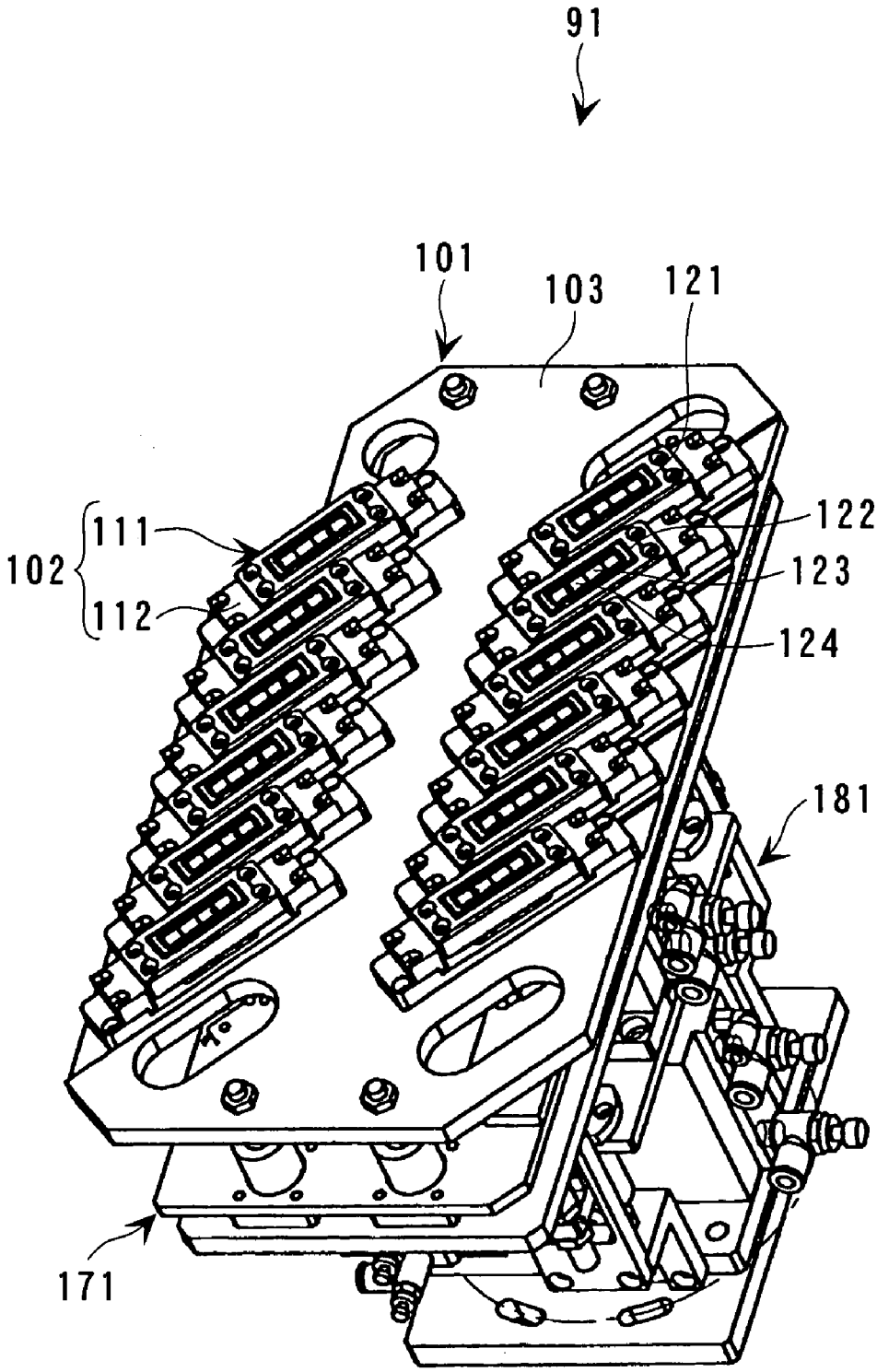
FIG. 7 is a perspective view of a suction unit according to the embodiment.
Figure 14:
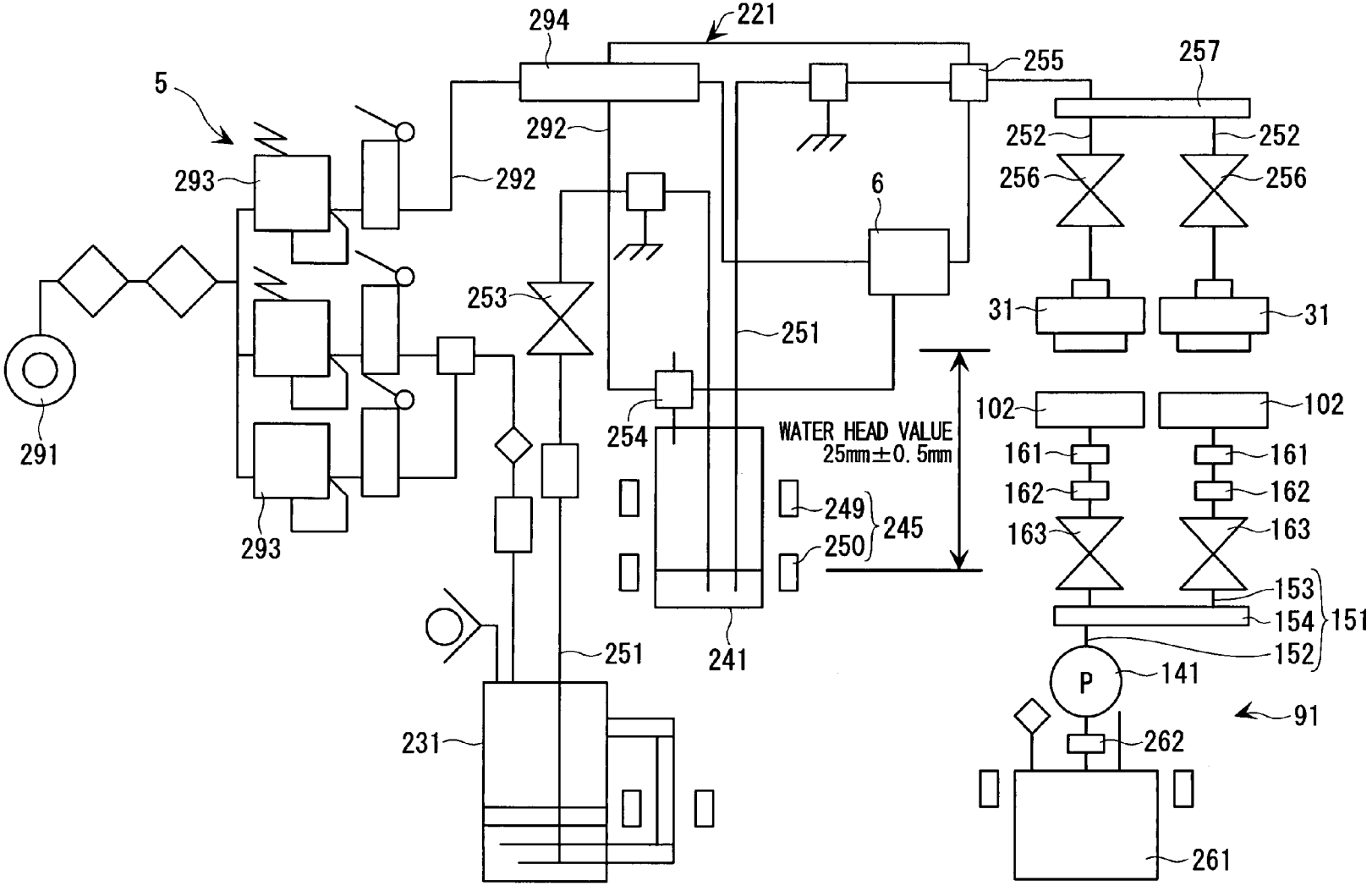
FIG. 14 is a view showing a piping system of the imaging apparatus according to the embodiment.

As shown in FIGS. 1 and 4, the suction unit 91 is placed on the common base 16 of the foregoing machine stage 13, which is disposed in the sub-scanning direction (the Y-axis direction) separately from the location of disposing the workpiece W, that is, the location of disposing the X-axis table 81. The suction unit 91 is arranged to be freely slidable in the main scanning direction (the X-axis direction), that is, the longitudinal direction of the machine stage 13, through the movable table 18. The suction unit 91 is for maintaining the liquid droplet ejection heads 31 by suction and is used in the cases of filling (the liquid droplet ejection heads 31 of) the head unit 21 with the function liquid and of performing suction (cleaning) for removing the thickened function liquid in the liquid droplet ejection heads 31. With reference to FIGS. 7 and 14, the suction unit 91 includes: a cap unit 101 having twelve caps 102; a function liquid suction pump 141 for sucking the function liquid through the caps 102; a suction tube unit 151 for connecting the respective caps 102 with the function liquid suction pump 141; a supporting member 171 for supporting the cap unit 101; and a lift mechanism 181 (capping means) for lifting up and down the cap unit 101 through the supporting member 171.

As shown in FIG. 7, in the cap unit 101, the twelve caps 102 are disposed on a cap base 103 in accordance with the disposition of the twelve liquid droplet ejection heads 31 mounted on the head unit 21. The respective caps 102 can be adhered to the corresponding liquid droplet ejection heads 31.

Figure 9:
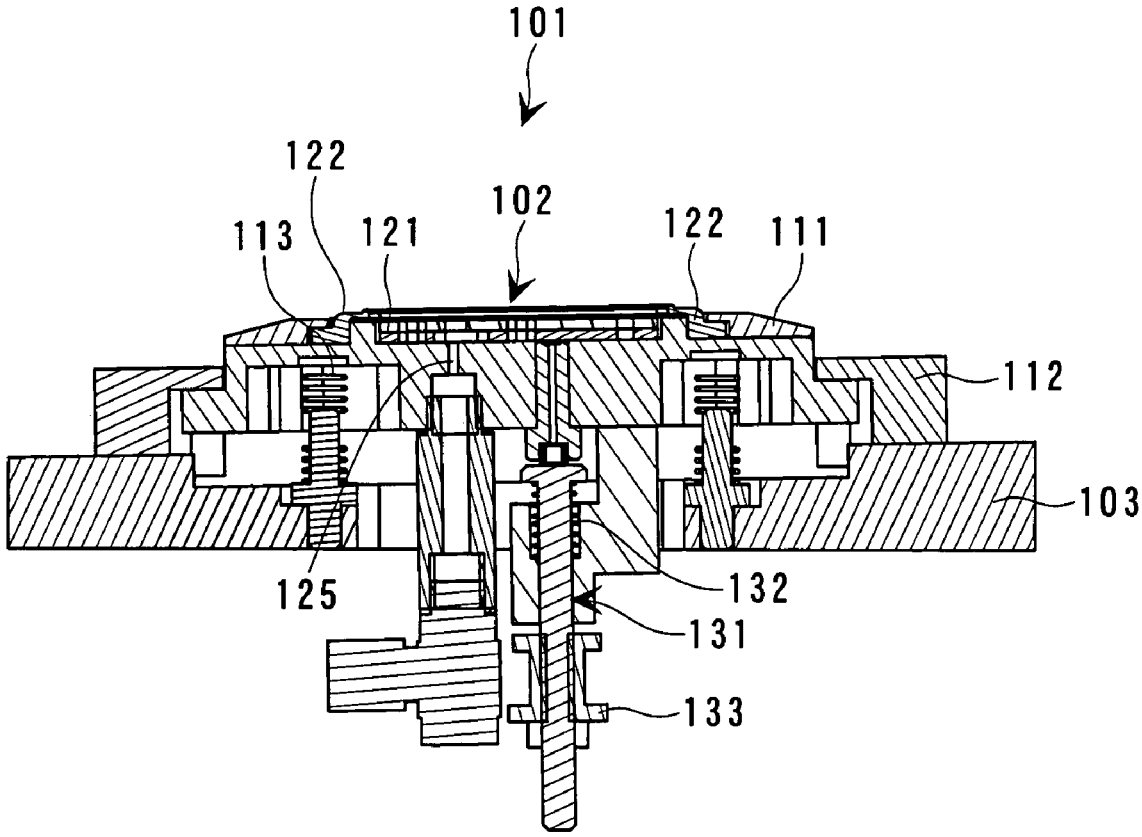
FIG. 9 is a cross-sectional view of a cap provided in the suction unit according to the embodiment.

As shown in FIG. 9, each of the caps 102 includes a cap main body 111 and a cap holder 112. The cap main body 111 is urged upward by two springs 113 and held by the cap holder 112 in a state of being capable of slight vertical movement. In an upper surface of the cap main body 111, a concave part 121 is formed, which includes each of the two arrays of ejection nozzles 42 of the liquid droplet ejection heads 31. In a peripheral portion of the concave part 121, a seal packing 122 is fitted. An absorber 123 is laid on a bottom of the concave part 121 in a state of being pressed by a pressing frame 124. In suction of the liquid droplet ejection head 31, the seal packing 122 is pressed against the nozzle forming surface 44 of the liquid droplet ejection head 31 and is adhered thereto (or is brought into close contact therewith). Thus, the nozzle forming surface 44 is sealed so as to include the two arrays of ejection nozzles 42 therein. Moreover, a small hole 125 is formed in the bottom of the concave part 121 and this small hole 125 communicates with an L-joint connected to each suction branch tube 153 to be described later.

Moreover, a relief valve 131 is provided in each of the caps 102 so as to open to atmosphere at the bottom side of the concave part 121 (see FIG. 9). The relief valve 131 is urged upward to a closing side by a spring 132 and is opened/closed through an operating plate 176 to be described later. At the final stage of the suction operation for the function liquid, an operating part 133 of the relief valve 131 is pulled down through the operating plate 176 and the relief valve is opened. Thus, the function liquid contained in the absorber 123 can be also sucked.

The function liquid suction pump 141 applies a sucking force to the liquid droplet ejection head 31 through each cap 102 and is arranged by using a piston pump in consideration of maintenance.

As shown in FIG. 14, the suction tube unit 151 includes: a function liquid suction tube 152 connected to the function liquid suction pump 141; a plurality of (twelve) suction branch tubes 153 connected to the respective caps 102; and a header pipe 154 for connecting the function liquid suction tube 152 with the suction branch tubes 153. Specifically, by using the function liquid suction tube 152 and the suction branch tubes 153, a function liquid passage connecting the caps 102 with the function liquid suction pump 141 is formed. As shown in FIG. 14, for each of the suction branch tubes 153, a liquid sensor 161, a cap-side pressure sensor 162 and a suction opening and closing valve 163 are sequentially provided from the cap 102 side. The liquid sensor 161 detects the presence of the function liquid and the cap-side pressure sensor 162 detects a pressure inside the suction branch tube 153. Moreover, the suction opening and closing valve 163 blocks the suction branch tube 153.

Figure 8:
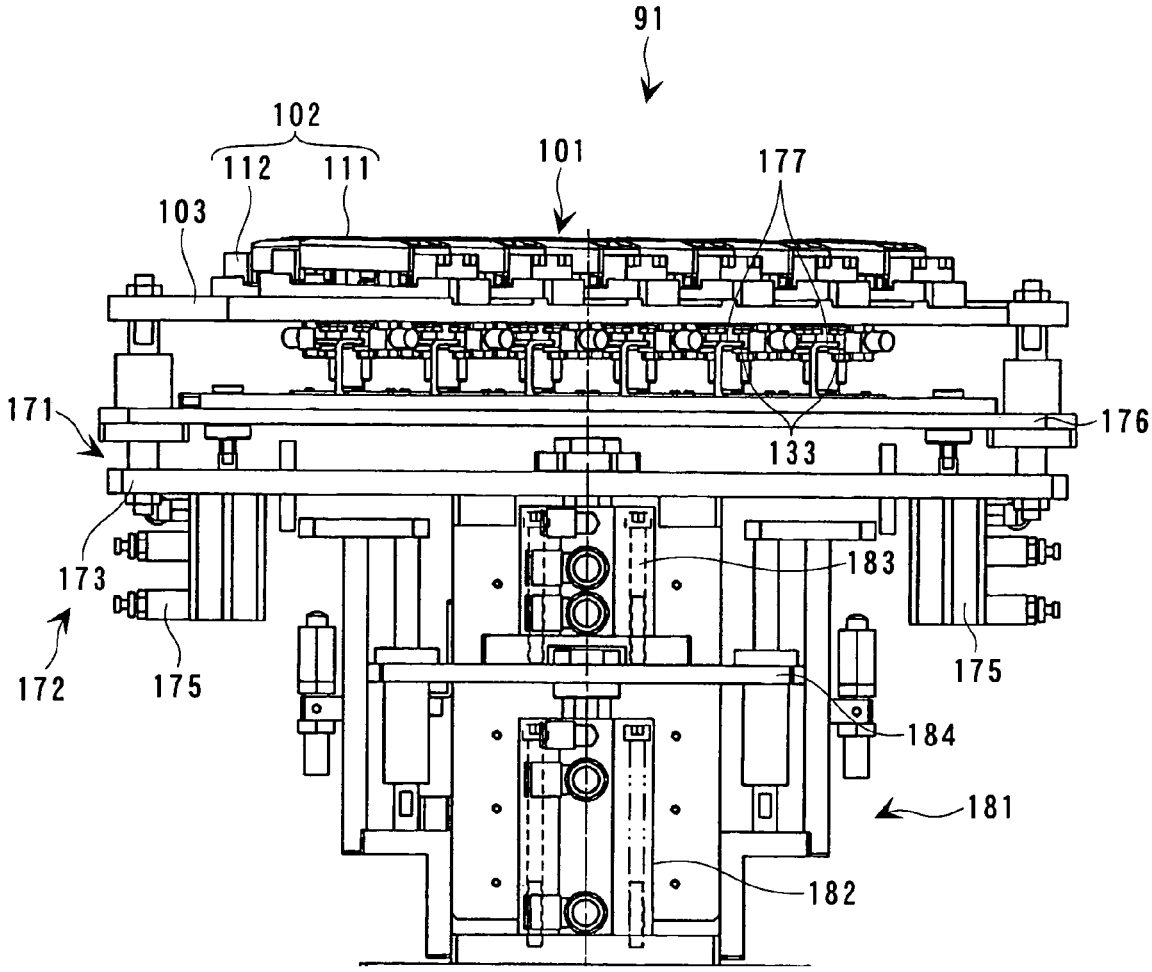
FIG. 8 is a front view thereof.

As shown in FIG. 8, the supporting member 171 includes: a supporting member main body 172 having a supporting plate 173 which supports the cap unit 101 thereabove; and a stand 174 which supports the supporting member main body 172 as slidable in the vertical direction. A pair of air cylinders 175 are fixed to a lower surface at both sides in the longitudinal direction of the supporting plate 173. This pair of air cylinders 175 lift up and down the operating plate 176. On the operating plate 176, a hook 177 engaged with the operating part 133 of the relief valve 131 of each cap 102 is attached. The foregoing relief valve 131 is opened or closed in such a manner that the hook 177 lifts up and down the operating part 133 along with the up-and-down movement of the operating plate 176.

As shown in FIG. 8, the lift mechanism 181 includes two lift cylinders formed of air cylinders, which are: a lower lift cylinder 182 provided upright on a base of the stand 174; and an upper lift cylinder 183 provided upright on a lift plate 184 which is lifted up and down by the lower lift cylinder 182. On the supporting plate 173, a piston rod of the upper lift cylinder 183 is joined. Both the lift cylinders 182 and 183 have different strokes from each other. A selection operation by the both lift cylinders 182 and 183 can freely switch a lifted position of the cap unit 101 between a first position, which is relatively high, and a second position, which is relatively low. When the cap unit 101 is at the first position, each cap 102 is adhered to each liquid droplet ejection head 31 and, when the cap unit 101 is at the second position, there occurs a narrow gap between the liquid droplet ejection head 31 and the cap 102.

As described later in detail, each cap 102 of the cap unit 101 also serves as a liquid droplet tray which catches the function liquid ejected by flushing (preliminary ejection) of the liquid droplet ejection head 31 in no ejection of the function liquid. In the case of sucking the liquid droplet ejection head 31 through the cap 102, such as filling the inner passage of the liquid droplet ejection head 31 with the function liquid and cleaning the liquid droplet ejection head 31, the lift mechanism 181 moves the cap unit 101 to the first position so as to adhere the cap 102 on the liquid droplet ejection head 31. In the case where the liquid droplet ejection head 31 performs the flushing, the lift mechanism 181 moves the cap unit 101 to the second position.

The wiping unit 92 wipes the nozzle forming surface 44 of the liquid droplet ejection head 31 contaminated by the function liquid adhered thereon by performing suction (cleaning) of the liquid droplet ejection head 31 and the like. The wiping unit 92 includes a winding unit 191 and a wipe-away unit 192, which are disposed face to face on the common base 16 (see FIGS. 1, 3 and 4). For example, as the cleaning of the liquid droplet ejection head 31 is finished, the wiping unit 92 is moved to a position fronting the liquid droplet ejection head 31 by the foregoing movable table 18. Thereafter, in a state of being sufficiently close to the liquid droplet ejection head 31, the wiping unit 92 takes out a wiping sheet (not illustrated) from the winding unit 191 and wipes the nozzle forming surface 44 of the liquid droplet ejection head 31 with the wiping sheet by using a wiping roller of the wipe-away unit 192. A cleaning fluid is applied to the wiping sheet from a cleaning fluid supply system 223 to be described later and thus the function liquid adhered on the liquid droplet ejection head 31 can be efficiently wiped off.

The flushing operation (preliminary ejection) of the liquid droplet ejection head 31 is also performed during the imaging operation. Thus, a flushing unit 93 having a pair of flushing boxes 93*a* fixed so as to sandwich the suction table 71 therebetween is provided on the θ table 73 of the X-axis table 71 (see FIG. 4). The flushing boxes 93*a* are moved together with the θ table 73 in the main scanning. Thus, the head unit 21 and the like are not moved for the flushing operation. Specifically, the flushing boxes 93*a* are moved together with the workpiece W toward the head unit 21. Thus, the flushing operation can be sequentially performed from the ejection nozzles 42 of the liquid droplet ejected on head 31 fronting the flushing boxes 93*a*. The function liquid received by the flushing boxes 93*a* is stored in a waste liquid tank 282 to be described later. Moreover, in a side portion at a side opposite to the machine stage 13 of the stone surface plate 12, a backup flushing unit 94 having a pair of flushing boxes 94*a* corresponding to the two arrays of liquid droplet ejection heads 31 of the head unit 21 is disposed.

In the flushing operation, the function liquid is ejected from all the ejection nozzles 42 of all the liquid droplet ejection heads 31. The flushing operation is periodically performed to prevent occurrence of clogging in the ejection nozzles 42 of the liquid droplet ejection heads 31. Specifically, the clogging occurs when the function liquid introduced to the liquid droplet ejection heads 31 is thickened by drying along with the passage of time. It is necessary to perform the flushing operation not only in the imaging operation but also in replacing the workpiece W and in temporarily halting the imaging operation (standby). In this case, the head unit 21 is moved to a cleaning position, that is, a portion immediately above the cap unit 101 of the suction unit 91 and, thereafter, the respective liquid droplet ejection heads 31 perform the flushing toward the respective caps 102 corresponding thereto.

In the case of performing the flushing toward the caps 102, the cap unit 101 is lifted up by the lift mechanism 181 to the second position where a narrow gap (a liquid droplet ejection space) occurs between the liquid droplet ejection head 31 and the cap 102. Thus, a large part of the function liquid ejected by the flushing can be received by the respective caps 102.

Next, the function liquid supply/recovery means 4 will be described. The function liquid supply/recovery means 4 includes: a function liquid supply system 221 which supplies the function liquid to the respective liquid droplet ejection heads 31 of the head unit 21; a function liquid recovery system 222 which recovers the function liquid sucked by the suction unit 91 of the maintenance means 3; the cleaning fluid supply system 223 which supplies a solution made of functional materials to the wiping unit 92 for cleaning; and a waste liquid recovery system 224 which recovers the function liquid received by the flushing unit 93 or the backup flushing unit 94. As shown in FIG. 3, in the large housing chamber 14 of the machine stage 13, a pressurization tank 231 of the function liquid supply system 221, a recycling tank 261 of the function liquid recovery system 222 and a cleaning fluid tank 271 of the cleaning fluid supply system 223 are horizontally disposed in this order from the right side of the figure. In addition, in the vicinity of the recycling tank 261 and the cleaning fluid tank 271, a small-sized waste liquid tank 282 of the waste liquid recovery system 224 and a small-sized recovery trap 263 of the function liquid recovery system 222 are provided.

As shown in FIG. 14, the function liquid supply system 221 includes: the pressurization tank 231 which stores a large amount (3 liters) of the function liquid; a liquid supply tank 241 which stores the function liquid sent from the pressurization tank 231 and supplies the function liquid to the respective liquid droplet ejection heads 31; and a supply tube 251 which forms liquid supply lines and connect these supply lines by piping. The pressurization tank 231 forcibly feeds the function liquid stored through the supply tube 251 to the liquid supply tank 241 by using compressed gas (inert gas) introduced from the air supply means 5.

Figure 10:
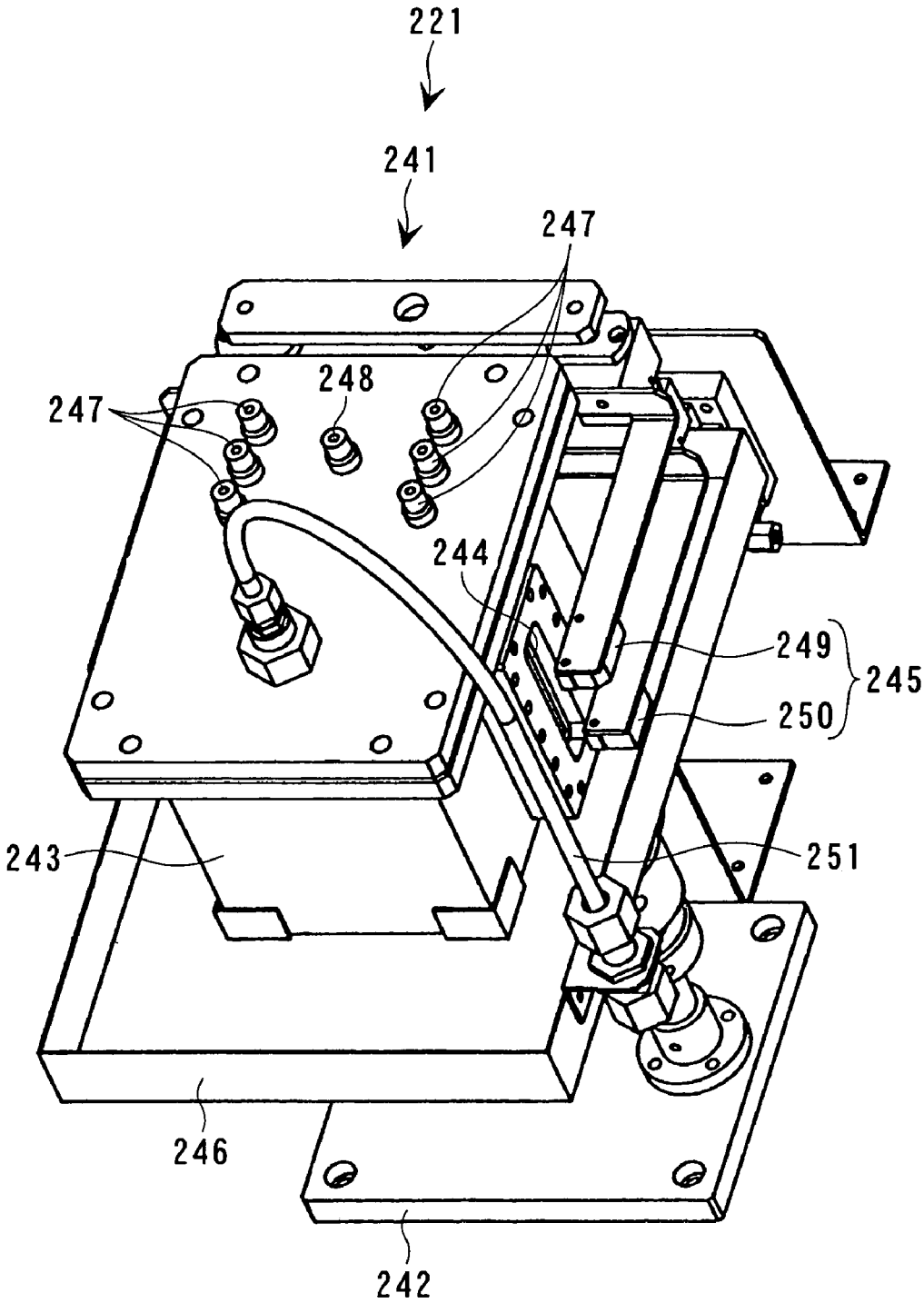
FIG. 10 is a perspective view of a supply tank according to the embodiment.

As shown in FIG. 10, the liquid supply tank 241 is fixed to the above-described tank base 17 of the machine stage 13 and includes: liquid level windows 244 on both sides thereof; a tank main body 243 which stores the function liquid from the pressurization tank 231; a liquid level detector 245 which detects a liquid level (a water level) of the function liquid while facing the both liquid level windows 244; a pan 246 on which the tank main body 243 is mounted; and a tank stand 242 which supports the tank main body 243 through the pan 246.

As shown in FIG. 10, the supply tube 251 continuing into the pressurization tank 231 is hooked up with an upper surface (a lid body) of the tank main body 243. Moreover, on the upper surface of the tank main body 243, provided are: six supply connectors 247 for the supply tube 251 extending to the head unit 21 side; and a pressurization connector 248 for an air supply tube 292 (to be described later) which is connected to the air supply means 5. The liquid level detector 245 includes: an overflow detection unit 249 for detecting an overflow of the function liquid; and a liquid level detection unit 250 for detecting the liquid level of the function liquid. A liquid level adjusting valve 253 is disposed in the supply tube 251 connected to the pressurization tank 231 and, by controlling the liquid level adjusting valve 253 to be opened or closed, the liquid level of the function liquid stored in the tank main body 243 is adjusted to be within a detection range of the liquid level detection unit 250 (in reality, the supply of the function liquid is performed for several seconds after the liquid level detection).

As described later in detail, in the air supply tube 292 connected to the pressurization connector 248, a three-way valve 254 (line opening and closing means) having a relief port (a port to open to atmosphere) is provided. Thus, a pressure from the pressurization tank 231 is cut off by relieving or venting to atmosphere. Consequently, a water head pressure of the supply tube 251 extending toward the head unit 21 is maintained to be slightly negative (for example, 25 mm±0.5 mm) by the above-described liquid level control and thus dripping of the function liquid from the ejection nozzles 42 of the liquid droplet ejection heads 31 is prevented. At the same time, the liquid droplets are accurately ejected by a pumping action of the liquid droplet ejection heads 31, that is, a pump drive of a piezoelectric element in the pump part 41.

As shown in FIG. 14, in each of the six liquid supply tubes 251 extending to the liquid droplet ejection heads 31, a head-side pressure sensor 255 (pressure detection means), which is connected to a pressure controller 294 to be described later, is disposed in the vicinity of the liquid droplet ejection heads 31. Moreover, each of the six liquid supply tubes 251 is biforked through a T-joint 257 and thus twelve liquid supply branch tubes 252 (branch supply lines) are formed in total (see FIG. 14). The twelve liquid supply branch tubes 252 are connected to the twelve sockets 57 of the piping joint 56 provided in the head unit 21 as the device side piping member. In each of the liquid supply branch tubes 252, a supply valve 256 for blocking the branched supply tube is provided. Opening and closing of the supply valve 256 is controlled by the control means 7.

The function liquid recovery system 222 is for storing the function liquid sucked by the suction unit 91 and includes: a recycling tank 261 which stores the sucked function liquid; and a recovery tube 262 which is connected to the function liquid suction pump 141 and introduces the sucked function liquid to the recycling tank 261.

The cleaning fluid supply system 223 is for supplying the cleaning fluid to the wiping sheet of the wiping unit 92 and includes: a cleaning fluid tank 271 which stores the cleaning fluid; and a cleaning fluid supply tube (not illustrated) for supplying the cleaning fluid of the cleaning fluid tank 271. The supply of the cleaning fluid is performed by introducing compressed air to the cleaning fluid tank 271 from the air supply means 5. Moreover, a function liquid solution is used as the cleaning fluid.

The waste liquid recovery system 224 is for recovering the function liquid ejected to the flushing unit 93 and the backup flushing unit 94 and includes: the waste liquid tank 282 which stores the recovered function liquid; and a waste liquid tube (not illustrated) which is connected to the flushing units 93 and 94 and guides the function liquid ejected to the flushing unit 93 to the waste liquid tank 282.

Next, the air supply means 5 will be described. As shown in FIG. 14, the air supply means 5 supplies compressed air obtained by compressing inert gas ($N_2$) to the respective parts such as the pressurization tank 231 and the liquid supply tank 241, for example. The air supply means 5 includes: an air pump 291 for compressing the inert gas; and the air supply tube 292 (pressurization line) for supplying the compressed air compressed by the air pump 291 to the respective parts. In the air supply tube 292, a regulator 293 is provided for maintaining a pressure therein at a predetermined constant pressure in accordance with a destination to which the compressed air is supplied.

As described later in detail, the imaging apparatus 1 according to the embodiment is arranged to pressurize the liquid supply tank 241 based on the foregoing head side pressure sensor 255. In the air supply tube 292 connected to the liquid supply tank 241, the pressure controller 294 connected to the head side pressure sensor 255 and the three-way valve 254 having the relief port are disposed. The pressure controller 294 sends the compressed air sent from the regulator 293 to the liquid supply tank 241 by appropriately decompressing the compressed air and controls the opening and closing of the three-way valve 254. Thus, the pressure applied to the liquid supply tank 241 can be controlled.

Moreover, in the embodiment, the compressed air is directly introduced into the pressurization tank 231 and the liquid supply tank 241. However, the pressurization tank 231 and the liquid supply tank 241 may be separately housed in pressurized boxes (not illustrated), made of aluminum or the like and the pressurization tank 231 and the liquid supply tank 241 may be pressurized separately from each other through the pressurized boxes. To be more specific, vent holes or the like are provided in the pressurization tank 231 and the liquid supply tank 241 to allow the pressurization tank 231 and the liquid supply tank 241 to communicate with the insides of the pressurized boxes. Thus, pressures inside the pressurized boxes, the pressurization tank 231 and the liquid supply tank 241 are maintained the same. Subsequently, by supplying the compressed air from the air pump 291 to the pressurized boxes, the insides of the pressurization tank 231 and the liquid supply tank 241 are pressurized.

Next, the control means 7 will be described. The control means 7 includes a control unit for controlling operations of the respective means. The control unit stores control programs and control data therein and has a work area for performing various control processing. The control means 7 is connected to the respective means described above and controls the entire device.

Here, with reference to FIG. 14, as an example of the control by the control means 7, description will be made about a case where the function liquid is supplied to the liquid droplet ejection heads 31 from the liquid supply tank 241. As described above, the imaging apparatus 1 according to the embodiment supplies the function liquid to the liquid droplet ejection heads 31 from the liquid supply tank 241 by using the pump action of the liquid droplet ejection heads 31. Accordingly, the imaging apparatus 1 is affected by friction resistance of the pipes from the liquid supply tank 241 to the liquid droplet ejection heads 31, and the like. Therefore, depending on the kind of the function liquid introduced into the liquid droplet ejection heads 31, the supply pressure of the function liquid in the liquid droplet ejection heads 31 is changed and the supply of the function liquid by the pump action of the liquid droplet ejection heads 31 is delayed. Thus, there may arise a problem that the function liquid cannot be properly ejected in the middle of the processing. Consequently, by pressurizing the inside of the liquid supply tank 241 based on the foregoing head side pressure sensor 255 in the ejection of the function liquid, the supply pressure of the function liquid is maintained constant, the ejection of the function liquid from the liquid droplet ejection heads 31 is stabilized and the delay of the supply of the function liquid to the liquid droplet ejection heads 31 is prevented.

Figure 11:
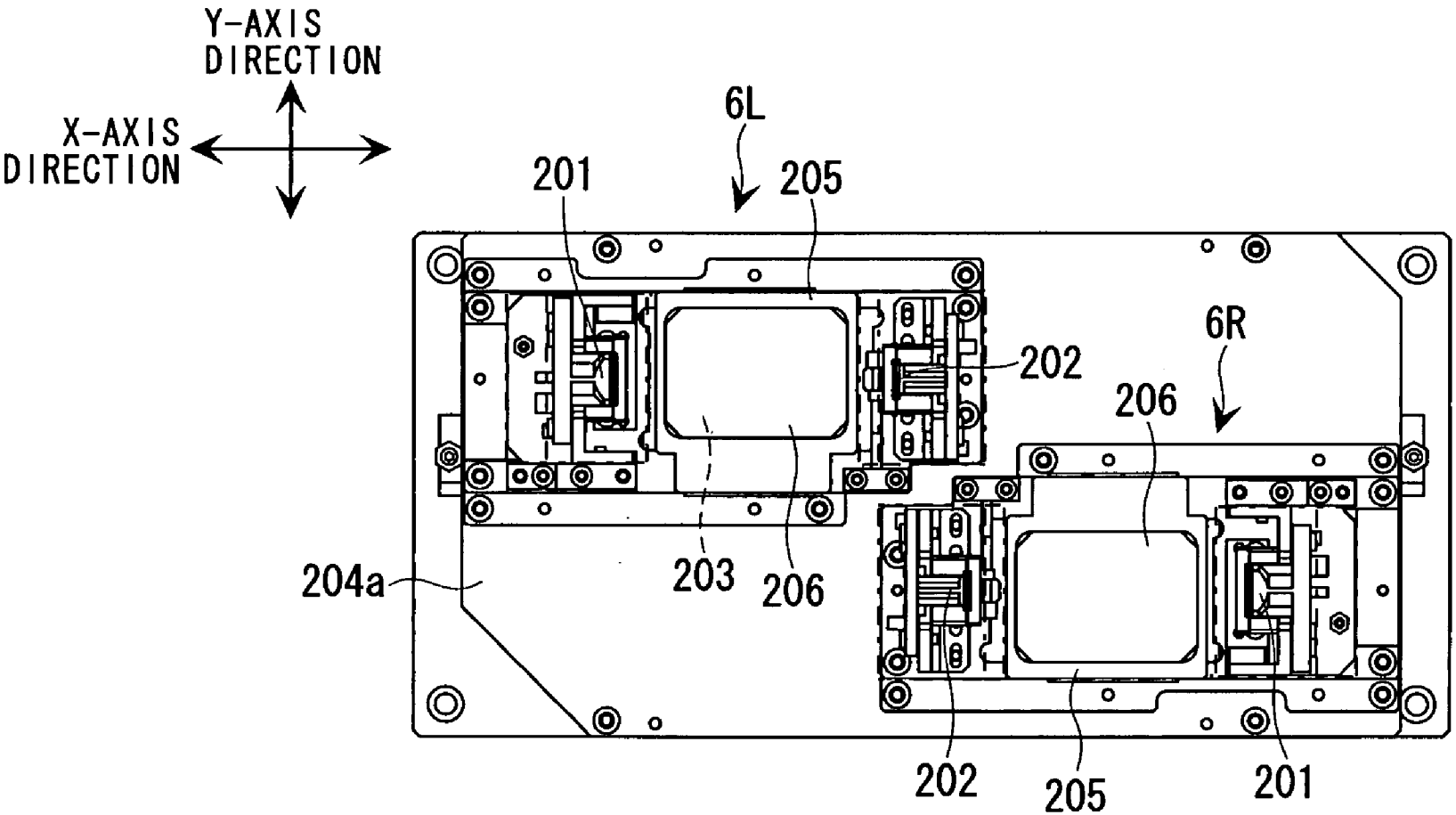
FIG. 11 is a plan view of liquid droplet detection means according to the embodiment.
Figure 12:
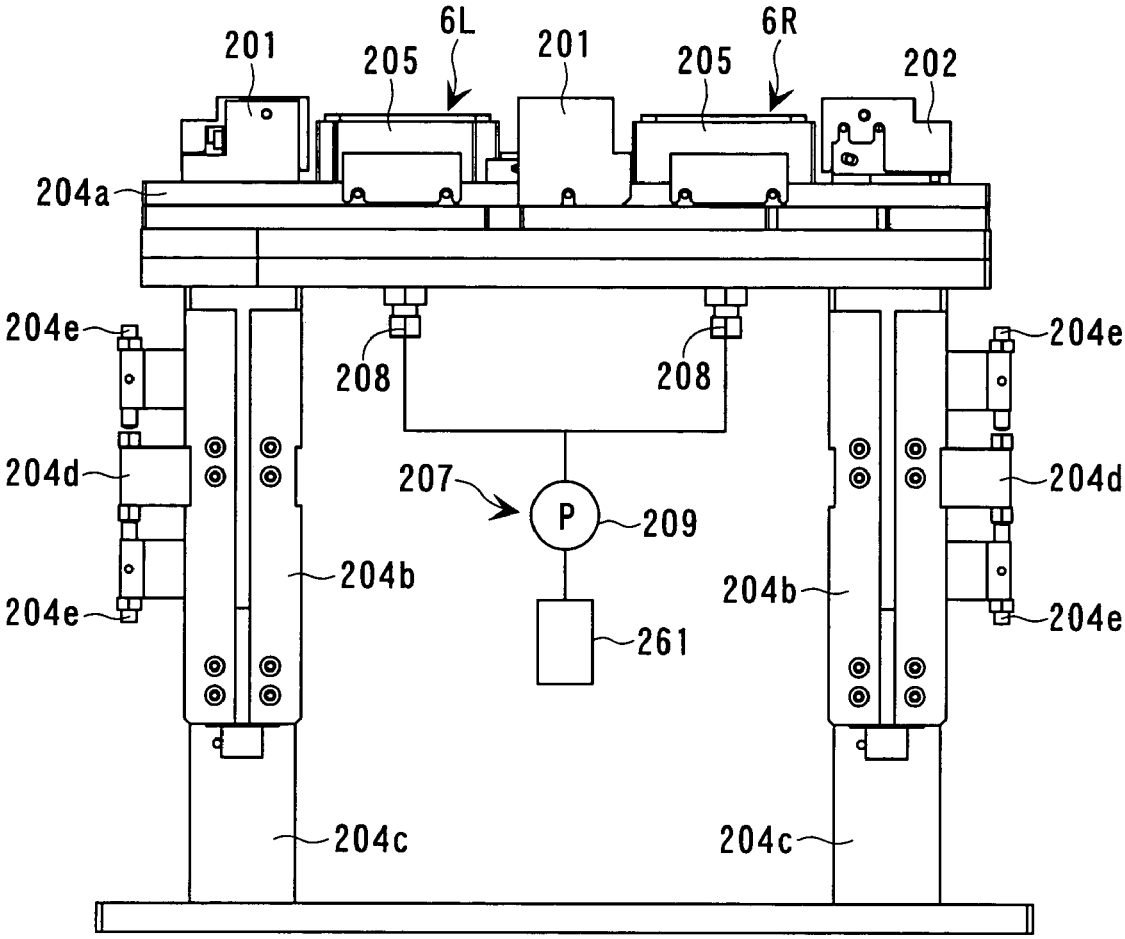
FIG. 12 is a front view thereof.
Figure 13:
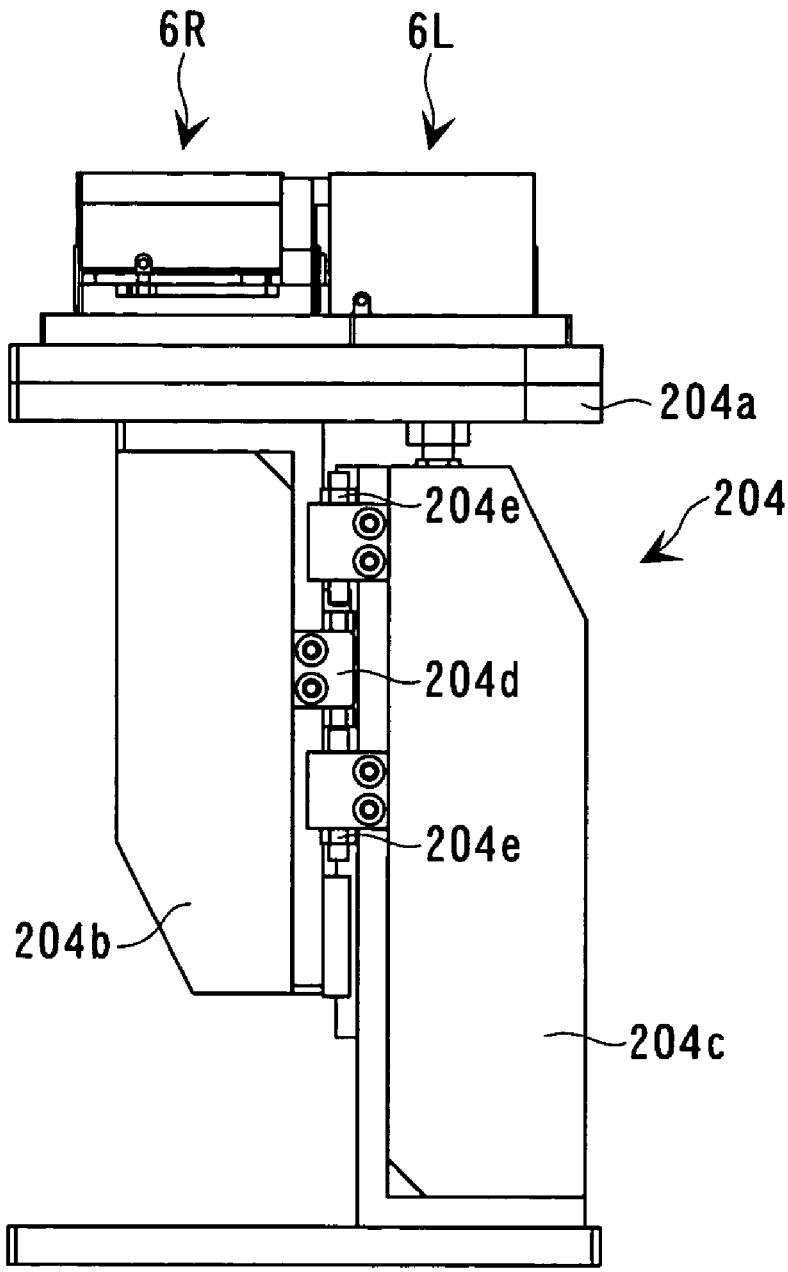
FIG. 13 is a right side view thereof.

Next, the liquid droplet detection means 6L and 6R will be described. As shown in FIGS. 11 to 13, each of the liquid droplet detection means 6L and 6R includes a light emitting element 201 and a light receiving element 202, which are formed of laser diodes or the like. Each of the liquid droplet detection means 6L and 6R is arranged to input a light receiving signal of the light receiving element 202 to the control means 7 and to detect the function liquid based on a change in an amount of light received by the light receiving element 202 when the function liquid crosses an optical path 203 between the light emitting element 201 and the light receiving element 202.

Here, one liquid droplet detection means 6L corresponds to one of the two arrays of the liquid droplet ejection heads 31 mounted on the head unit 21 and the other liquid droplet detection means 6R corresponds to the other array of the liquid droplet ejection heads 31 on the head unit 21. After completion of the maintenance operation such as flushing performed when the imaging operation is halted, before starting the next imaging operation, it is confirmed by using the liquid droplet detection means 6L and 6R whether or not the function liquid is normally ejected from the ejection nozzles 42 of the respective arrays of the liquid droplet ejection heads 31.

In manufacturing the liquid crystal display and the organic EL device, which will be described later, no defective products are produced even if the function liquid is ejected somewhat obliquely from the ejection nozzles 42. Thus, a diameter of a beam emitted from the light emitting element 201 is set to a value larger (for example, 90 μm) than a diameter of the function liquid droplet (for example, 27 μm) and a distance between the ejection nozzle 42 and the optical path 203 is set to about 1 mm. Consequently, the liquid droplets can be detected even if the function liquid is ejected somewhat obliquely from the ejection nozzles 42.

As shown in FIG. 4, the liquid droplet detection means 6L and 6R are disposed on the common base 16 while being positioned between the place where the X-axis table 81 is disposed and the place where the suction unit 91, that is, the maintenance means 3, is disposed. To be more specific, as shown in FIGS. 11 to 13, a stand 204 to be fixed to the common base 16 is provided and the liquid droplet detection means 6L and 6R are disposed on an upper plate 204*a* of the stand 204. The upper plate 204*a* is supported as vertically movable by a pair of columns 204*c* of the stand 204 by using a pair of sliders 204*b* provided perpendicularly to the upper plate 204*a*. Adjusting screws 204*e* abutting on upper and lower ends of abutting screws 204*d* attached to the sliders 204*b* are provided in the columns 204*c*. Thus, it is made possible to perform positional adjustment of the upper plate 204*a*, that is, the liquid droplet detection means 6L and 6R, in the vertical direction and horizontal adjustment thereof.

A space between the places where the X-axis table 81 and the suction unit 91 are disposed is originally a dead space and a width thereof in the Y-axis direction is relatively narrow. In order to dispose the liquid droplet detection means 6L and 6R in this space without trouble, the light emitting element 201 and the light receiving element 202 of each of the liquid droplet detection means 6L and 6R are located to be opposite to each other in the X-axis direction and thus a size of the liquid droplet detection means 6L and 6R in the Y-axis direction is reduced.

Moreover, when both the liquid droplet detection means 6L and 6R are horizontally disposed on the same line along the X-axis direction, for the purpose of avoiding interference between the elements positioned in both the liquid droplet detection means 6L and 6R in the X-axis direction, a width in the X-axis direction of an undetectable region between a detection effective region of the one liquid droplet detection means 6L (a region where the optical path 203 exists between the light emitting element 201 and the light receiving element 202) and a detection effective region of the other liquid droplet detection means 6R is increased. Consequently, a gap in the X-axis direction between the two arrays of the liquid droplet ejection heads 31 is inevitably increased and thus the head unit 21 grows in size.

Accordingly, in the embodiment, both the liquid droplet detection means 6L and 6R are disposed at positions in the X-axis direction in accordance with the corresponding arrays of liquid droplet ejection heads 31, the positions being shifted from each other in the Y-axis direction. Thus, the element (the light receiving element 202) positioned inside of the one liquid droplet detection means 6L in the X-axis direction and the element (the light receiving element 202) positioned inside of the other liquid droplet detection means 6R in the X-axis direction can be overlapped with each other in the X-axis direction and thus the width in the X-axis direction of the undetectable region between both the liquid droplet detection means 6L and 6R can be narrowed. Consequently, the gap in the X-axis direction between the two arrays of the liquid droplet ejection heads 31 does not have to be wide and thus the head unit 21 does not have to be increased in size.

It is also possible to perform the operation of confirming the liquid droplet ejection to the two arrays of the liquid droplet ejection heads 31 by using single liquid droplet detection means in such a manner that the common base 16 is moved by the movable table 18 and the liquid droplet detection means is shifted in the X-axis direction. However, if the two liquid droplet ejection means 6L and 6R corresponding to the two arrays of liquid droplet ejection heads 31 are provided as described in the embodiment, it is possible to simultaneously perform the operation of confirming the liquid droplet ejection to the two arrays of the liquid droplet ejection heads 31. Thus, the above arrangement is advantageous for the purpose of improving operation efficiency.

Moreover, in each of the liquid droplet detection means 6L and 6R, a liquid droplet tray 205 is provided under the optical path 203 between the light emitting element 201 and the light receiving element 202. An absorber 206 disposed in this liquid droplet tray 205 enables absorption of the function liquid ejected from the ejection nozzles 42. Furthermore, a piping joint 208 communicating with a bottom of the liquid droplet tray 205 is provided and a suction pump 209 continuing into the above-described recycling tank 261 is connected to this piping joint 208. Accordingly, function liquid recovery means 207 for the liquid droplet detection means is constituted, which recovers the function liquid ejected from the ejection nozzles 42 by suction through the absorber 206. Consequently, it is possible to recycle the function liquid ejected in the function liquid ejection confirming operation. Thus, a running cost can be reduced.

In the function liquid ejection confirming operation, by using the control means 7, the head unit 21 is continuously moved in the Y-axis direction in such a manner that the respective ejection nozzles 42 of each array of the liquid droplet ejection heads 31 are sequentially positioned immediately above the optical path 203 between the light emitting element 201 and the light receiving element 202 of each of the liquid droplet detection means 6L and 6R. Thereafter, detection timing is obtained by using a signal from the linear scale in the Y-axis direction (the Y-axis linear scale 84) and, at the same time, the function liquid is ejected from the ejection nozzles 42 positioned immediately above the optical path 203. Subsequently, depending on whether or not the function liquid is detected by the liquid droplet detection means 6L and 6R, it is determined whether or not the function liquid is normally ejected from the ejection nozzles 42. The light emitting element 201 may emit light in synchronization with the ejection of the function liquid from the ejection nozzles 42 or may continue to emit light during the confirming operation.

Figure 15:
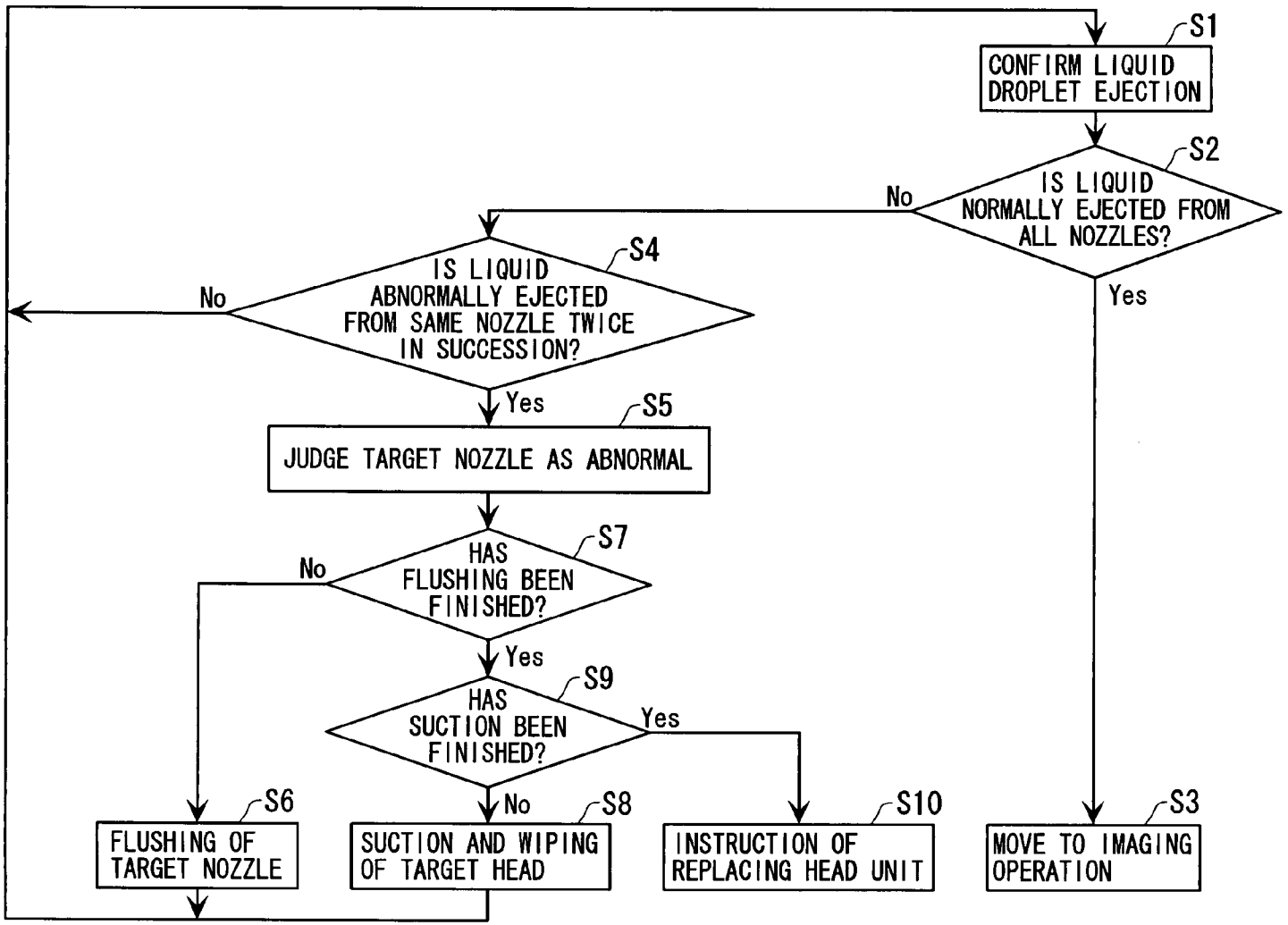
FIG. 15 is a flowchart showing a processing procedure for determining abnormality of ejection nozzles according to the embodiment.

As shown in FIG. 15, the function liquid ejection confirmation is performed for all the ejection nozzles 42 (S1) and, when the function liquid is normally ejected from all the ejection nozzles 42 (S2), the processing moves to the imaging operation (S3). When there is an ejection nozzle 42 in which the ejection of the function liquid is determined to be abnormal, the function liquid ejection confirmation is performed again for all the ejection nozzles 42. When the function liquid ejection from the same ejection nozzle 42 is determined to be abnormal twice in succession (S4), this ejection nozzle 42 is judged to be abnormal (S5). When it is determined in the second ejection confirmation operation that the function liquid ejection from an ejection nozzle 42 different from that of the previous operation is determined to be abnormal, the function liquid ejection confirmation is performed again for all the ejection nozzles 42.

Here, when the ejection confirmation operation of the function liquid is performed by using such optical liquid droplet detection means 6L and 6R having the light emitting element 201 and the light receiving element 202 as used in the embodiment, even if the function liquid is normally ejected from the ejection nozzles 42, the ejection may be determined to be abnormal due to satellite (floating misty particles resulting from an ejected liquid), electrical noise and the like. Accordingly, in the embodiment, as described above, when the ejection of the function liquid from the same ejection nozzle 42 is determined to be abnormal twice in succession, this ejection nozzle 42 is judged to be abnormal. Thus, an erroneous judgment can be prevented as much as possible.

When the ejection nozzle 42 is judged to be abnormal, flushing (preliminary ejection) is performed (S6), in which the function liquid is ejected toward the cap unit 101 at least from the ejection nozzle 42 judged to be abnormal. After the flushing, the function liquid ejection confirmation is performed again for all the ejection nozzles 42. Thereafter, when the ejection nozzle 42 is still judged to be abnormal in determination processing similar to that described above, since the flushing has been already performed (S7), suction and wiping are performed this time for the liquid droplet ejection head 31 having at least the ejection nozzle 42 judged to be abnormal by using the suction unit 91 and the wiping unit 92 (S8). Thereafter, the function liquid ejection confirmation is performed again for all the ejection nozzles 42.

Here, the abnormal ejection of the function liquid is mostly caused by minor clogging in the vicinity of the ejection nozzles 42. Thus, when the flushing of the ejection nozzles 42 is performed, it is likely to recover a state in which the function liquid is normally ejected. Consequently, even if the ejection nozzle 42 is once judged to be abnormal, the recovery of the ejection nozzle 42 by the flushing makes it possible to perform an efficient imaging operation using all the ejection nozzles 42, which is advantageous in terms of improving productivity.

Moreover, even if there occurs severe clogging that cannot be repaired by the preliminary ejection, suction of the ejection nozzles 42 may restore the state in which the function liquid is normally ejected. However, when the state cannot be restored even by the suction and the ejection nozzle 42 is judged to be abnormal again, since the suction has been already performed (S9), an instruction of replacing the head unit 21 is sent or issued this time regarding the head unit 21 as unusable (S10). Accordingly, an annunciator and the like is operated by this replacement instruction and the head unit 21 is replaced with a new one. In the embodiment, individual suction for each of the ejection nozzles 42 is impossible in terms of the structure of the cap unit 101. However, if the individual suction is possible, the suction of only the ejection nozzle 42 determined to be abnormal may be performed.

Moreover, by using the liquid droplet detection means 6L and 6R, the ejection of the function liquid can be detected but excess and deficiency of an ejection amount cannot be directly detected. Consequently, in the embodiment, as shown in FIG. 4, inspection means 8 for the ejection amount is disposed adjacently to the suction unit 91 in the common base 16. This inspection means 8 includes a plurality of liquid droplet trays 8*a* corresponding to the plurality of liquid droplet ejection heads 31 of the head unit 21 and is arranged to inspect the ejection amount based on a change in weight when liquid droplets are ejected more than once toward the respective liquid droplet trays 8*a* from the respective liquid droplet ejection heads 31. The inspection of the ejection amount is periodically executed with certain time intervals.

Next, as the electrooptic device (flat panel display) manufactured by using the liquid droplet ejection device 1 according to the embodiment, by using the color filter, the liquid crystal display, the organic EL device, the plasma display (PDP device), the electron-emitting device (FED device and SED device) and the like as examples, structures and manufacturing methods thereof will be described.

Figure 16:
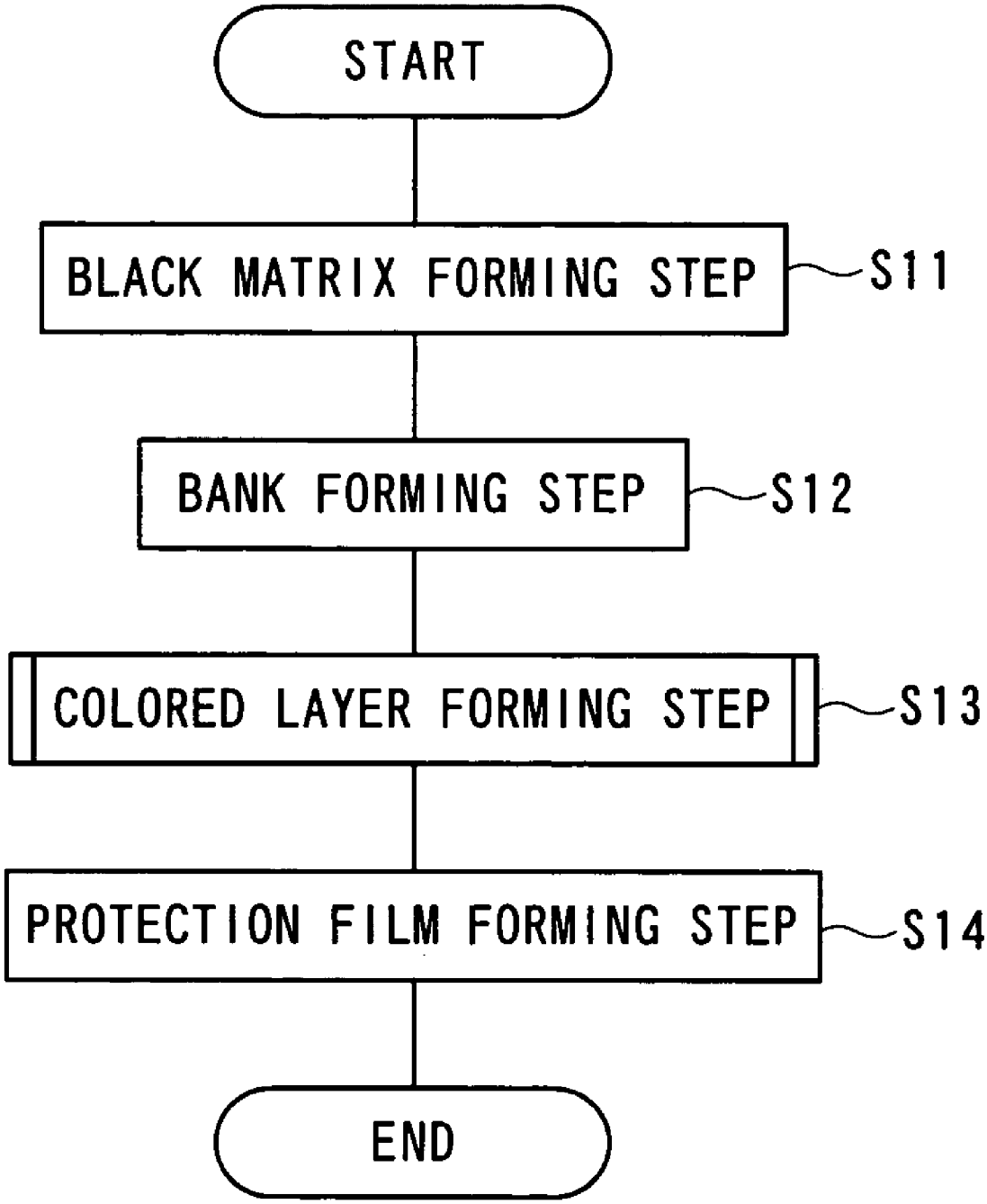
FIG. 16 is a flowchart explaining steps of manufacturing a color filter.

First, a method of manufacturing a color filter installed in the liquid crystal display, the organic EL device or the like will be described. FIG. 16 is a flowchart showing steps of manufacturing the color filter. FIGS. 17A to 17E are cross-sectional views schematically showing a color filter 500 (a filter substrate 500A) of the embodiment in the order of the manufacturing steps.

Figure 17A:
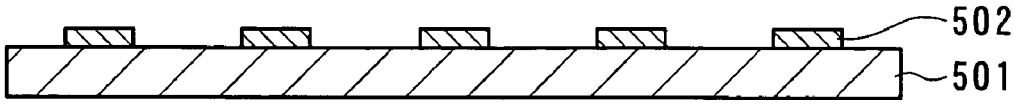
FIGS. 17A to 17E are cross-sectional views schematically showing the color filter in the order of the manufacturing steps.

First, in a black matrix formation step (S11), as shown in FIG. 17A, a black matrix 502 is formed on a substrate (W) 501. The black matrix 502 is formed by using a lamination body of chromium metal and chromium oxide, resin black or the like. For the formation of the black matrix 502 made of a metal thin film, a sputtering method, a deposition method or the like can be used. Moreover, in the case of forming the black matrix 502 made of a resin thin film, a gravure printing method, a photoresist method, a thermal transfer method or the like can be used.

Figure 17B:
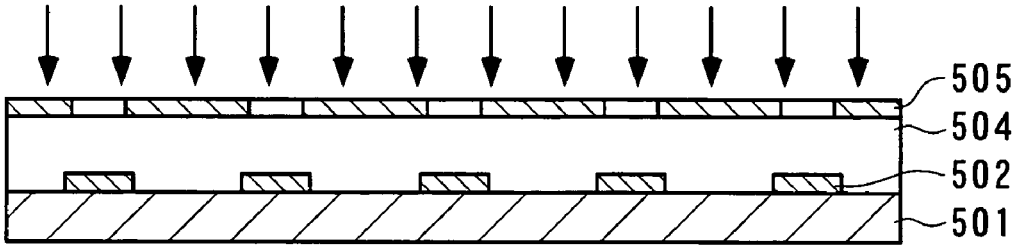

Subsequently, in a bank formation step (S12), a bank 503 is formed in a state of being superposed on the black matrix 502. Specifically, as shown in FIG. 17B, a resist layer 504 made of transparent negative-type photosensitive resin is first formed so as to cover the substrate 501 and the black matrix 502. Thereafter, an upper surface of the resist layer is coated with a mask film 505 formed to have a matrix pattern and exposure processing is performed in this state.

Figure 17C:
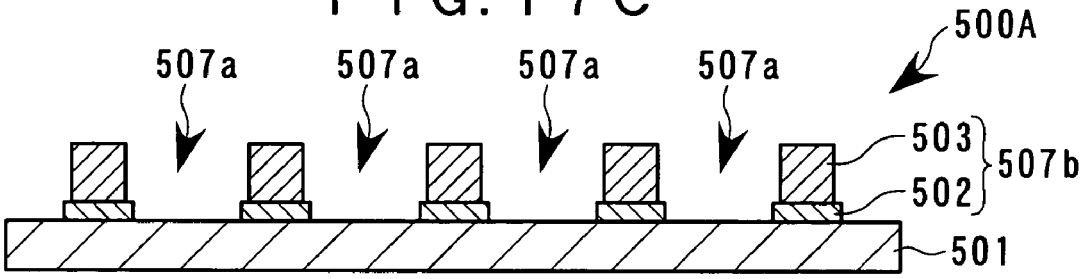

Furthermore, as shown in FIG. 17C, the resist layer 504 is patterned by etching an unexposed portion thereof and thus the bank 503 is formed. In the case of forming the black matrix by using the resin black, it is possible to use the black matrix and the bank in combination.

This bank 503 and the black matrix 502 therebelow become partition wall parts 507*b* which separate respective pixel regions 507*a* from each other. The partition wall parts 507*b* define shot areas of the function liquid in forming colored layers (film formation parts) 508R, 508G and 508B by using the liquid droplet ejection heads 31 in a following colored layer formation step.

Through the black matrix formation step and the bank formation step described above, the foregoing filter substrate 500A is obtained.

In the embodiment, as a material of the bank 503, used is a resin material that makes a coated film surface lyophobic (hydrophobic). Since a surface of the substrate (glass substrate) 501 is lyophilic (hydrophilic), positional accuracy of shots of liquid droplets into the respective pixel regions 507*a* surrounded by the bank 503 (the partition wall parts 507*b*) is improved in the colored layer formation step to be described later.

Figure 17D:
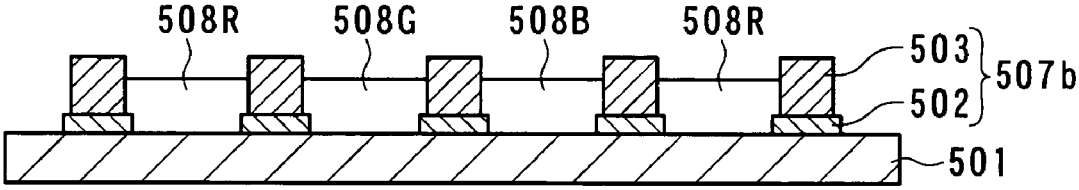

Next, in the colored layer formation step (S13), as shown in FIG. 17D, the function liquid is ejected by the liquid droplet ejection heads 31 into the respective pixel regions 507*a* surrounded by the partition wall parts 507*b*. In this case, the ejection of the function liquid is performed by using the liquid droplet ejection heads 31 and introducing function liquids (filter materials) of three colors including R, G and B. As an arrangement pattern of the three colors of R, G and B, there are stripe arrangement, mosaic arrangement, delta arrangement and the like.

Figure 17E:
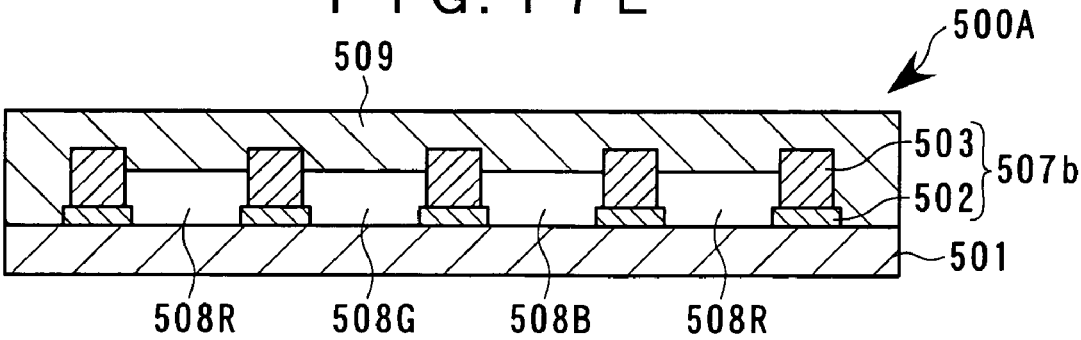

Thereafter, the function liquids are fixed through drying treatment (processing such as heating) and the colored layers 508R, 508G and 508B of the three colors are formed. When the colored layers 508R, 508G and 508B are formed, the processing moves to a protection film formation step (S14) and, as shown in FIG. 17E, a protection film 509 is formed so as to cover upper surfaces of the substrate 501, the partition wall parts 507*b* and the colored layers 508R, 508G and 508B.

Specifically, after a coating agent for the protection film is ejected to the entire surface of the substrate 501 in which the colored layers 508R, 508G and 508B are formed, the protection film 509 is formed through the drying treatment.

Subsequently, after forming the protection film 509, the substrate 501 is cut into individual effective pixel regions and thus the color filter 500 is obtained.

Figure 18:
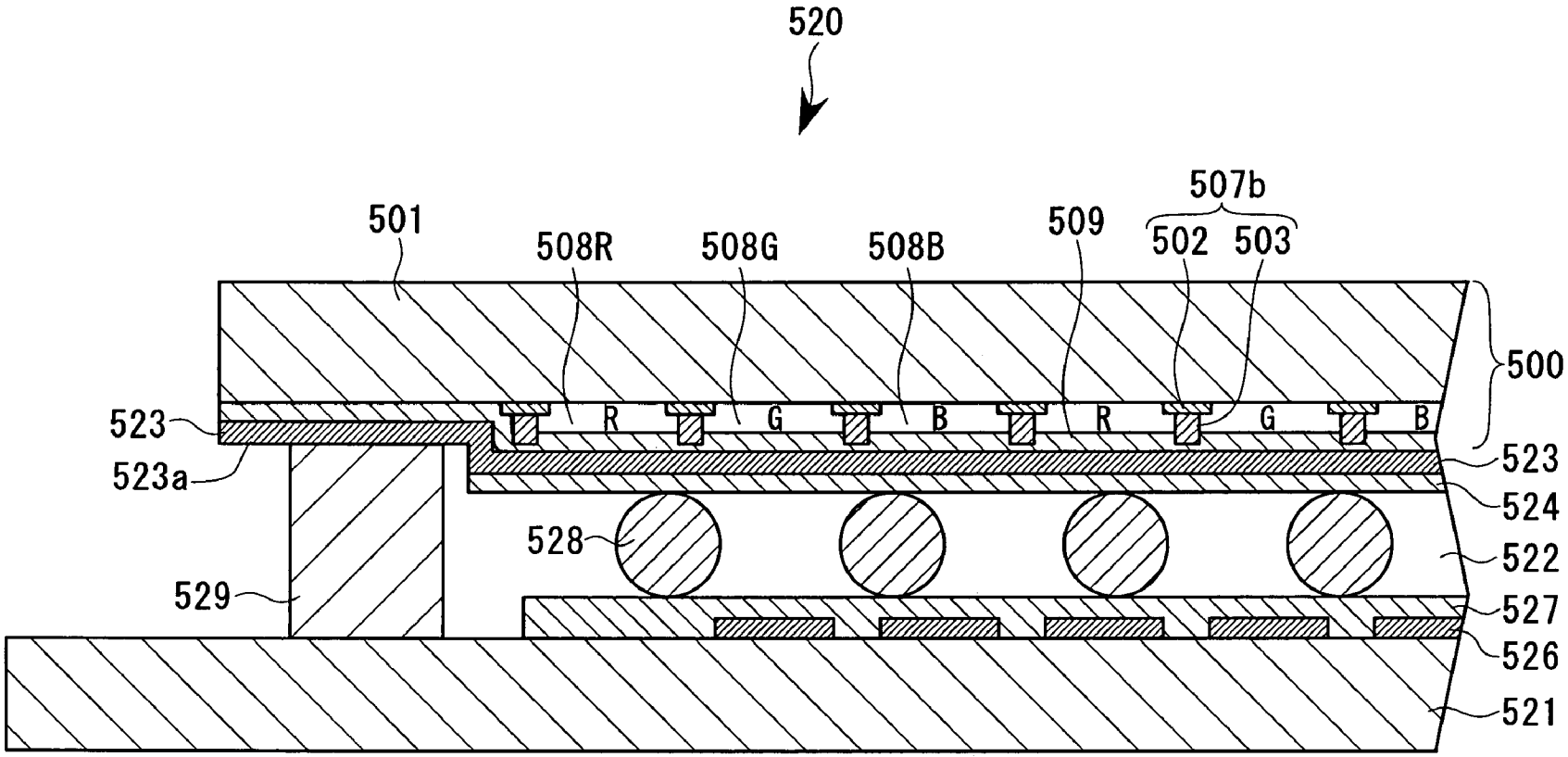
FIG. 18 is a cross-sectional view of a main part, showing a schematic constitution of a liquid crystal device using a color filter to which this invention is applied.

FIG. 18 is a cross-sectional view of a main part, showing a schematic constitution of a passive matrix liquid crystal device (liquid crystal device) as an example of a liquid crystal display using the above-described color filter 500. By mounting accessory elements such as an IC for driving liquid crystal, a backlight and a support on this liquid crystal device 520, a transparent liquid crystal display as a final product is obtained. The color filter 500 is the same as that shown in FIG. 17 and thus the corresponding parts are denoted by the same reference numerals and description thereof will be omitted.

This liquid crystal device 520 is schematically constituted by using the color filter 500, a counter substrate 521 made of a glass substrate or the like and a liquid crystal layer 522 made of a super twisted nematic (STN) liquid crystal composition, the liquid crystal layer 522 being sandwiched between the color filter 500 and the counter substrate 521. The color filter 500 is disposed at the upper side in the imaging (an observer side).

Polarizers (not illustrated) are disposed on outer surfaces (surfaces opposite to the liquid crystal layer 522 side) of the counter substrate 521 and the color filter 500, respectively. Moreover, outside of the polarizer positioned at the counter substrate 521 side, a backlight is provided.

On the protection film 509 of the color filter 500 (the liquid crystal layer side), a plurality of strip-shaped first electrodes 523, which are long in the right-and-left direction in FIG. 18, are formed at predetermined intervals. A first alignment layer 524 is formed so as to cover surfaces of these first electrodes 523, the surfaces being opposite to the color filter 500 side.

Meanwhile, on a surface of the counter substrate 521, which faces the color filter 500, a plurality of strip-shaped second electrodes 526, which are long in a direction orthogonal to the first electrodes 523 of the color filter 500, are formed at predetermined intervals. A second alignment layer 527 is formed so as to cover surfaces of these second electrodes 526 at the liquid crystal layer 522 side. These first and second electrodes 523 and 526 are formed by using a transparent conductive material such as ITO (indium tin oxide).

Spacers 528 provided in the liquid crystal layer 522 are members for maintaining a constant thickness (cell gap) of the liquid crystal layer 522. Moreover, a seal 529 is a member for preventing the liquid crystal composition in the liquid crystal layer 522 from leaking to the outside. Note that, as a laying wiring 523*a*, one end of each of the first electrodes 523 is extended to the outside of the seal 529.

Portions where the first and second electrodes 523 and 526 intersect with each other are pixels and the colored layers 508R, 508G and 508B of the color filter 500 are positioned in the portions to be the pixels.

In usual manufacturing steps, the parts at the color filter 500 side are prepared by subjecting the color filter 500 to the patterning of the first electrodes 523 and the coating of the first alignment layer 524. At the same time, the parts at the counter substrate 521 side are prepared by subjecting the counter substrate 521 to the patterning of the second electrodes 526 and the coating of the second alignment layer 527. Thereafter, the spacers 528 and the seal 529 are formed at the counter substrate 521 side and the parts at the color filter 500 side are attached thereto in this state. Subsequently, liquid crystal included in the liquid crystal layer 522 is injected from an inlet of the seal 529 and the inlet is sealed. Thereafter, both the polarizers and the backlight are laminated.

In the imaging apparatus 1 according to the embodiment, application of a spacer material (a function liquid) included in the above-described cell gap and, before attachment of the parts at the color filter 500 side to the parts at the counter substrate 521 side, for example, liquid crystal (a function liquid) can be evenly applied in a region surrounded by the seal 529. Moreover, printing of the above-described seal 529 can be performed by using the liquid droplet ejection heads 31. Furthermore, the coating of the first and second orientation films 524 and 527 can be also performed by using the liquid droplet ejection heads 31.

Figure 19:
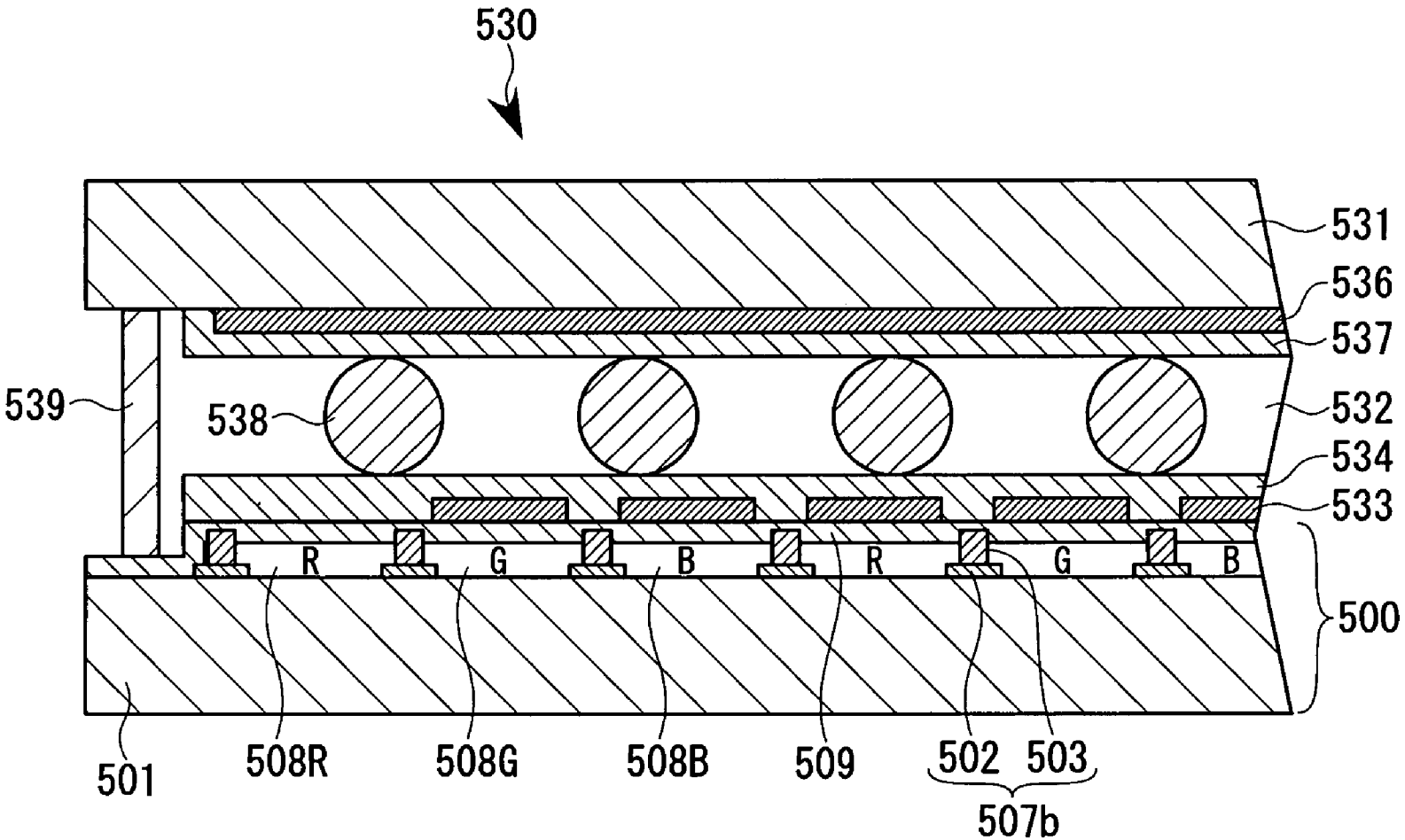
FIG. 19 is a cross-sectional view of a main part, showing a schematic constitution of a liquid crystal device of a second example using the color filter to which this invention is applied.

FIG. 19 is a cross-sectional view of a main part, showing a schematic constitution of a liquid crystal display of a second example, which uses the color filter 500 manufactured in the embodiment.

This liquid crystal device 530 is significantly different from the foregoing liquid crystal device 520 in a point that the color filter 500 is disposed at the lower side in the drawing (opposite to the observer side).

This liquid crystal device 530 is schematically constituted by sandwiching a liquid crystal layer 532 made of STN liquid crystal between the color filter 500 and a counter substrate 531 made of a glass substrate or the like. Polarizers (not illustrated) and the like are disposed on outer surfaces of the counter substrate 531 and the color filter 500, respectively.

On the protection film 509 of the color filter 500 (at the liquid crystal layer 532 side), a plurality of strip-shaped first electrodes 533 are formed at predetermined intervals, which are long in a depth direction in the drawing. A first alignment layer 534 is formed so as to cover surfaces of these first electrodes 533 at the liquid crystal layer 532 side.

On a surface of the counter substrate 531, which faces the color filter 500, a plurality of strip-shaped second electrodes 536 extending in a direction orthogonal to the first electrodes 533 at the color filter 500 side are formed at predetermined intervals. A second alignment layer 537 is formed so as to cover surfaces of these second electrodes 536 at the liquid crystal layer 532 side.

In the liquid crystal layer 532, provided are: spacers 538 for maintaining a constant thickness of this liquid crystal layer 532; and a seal 539 for preventing a liquid crystal composition in the liquid crystal layer 532 from leaking to the outside.

Similarly to the foregoing liquid crystal device 520, portions where the first and second electrodes 533 and 536 intersect with each other are pixels and the colored layers 508R, 508G and 508B of the color filter 500 are positioned in the portions to be the pixels.

Figure 20:
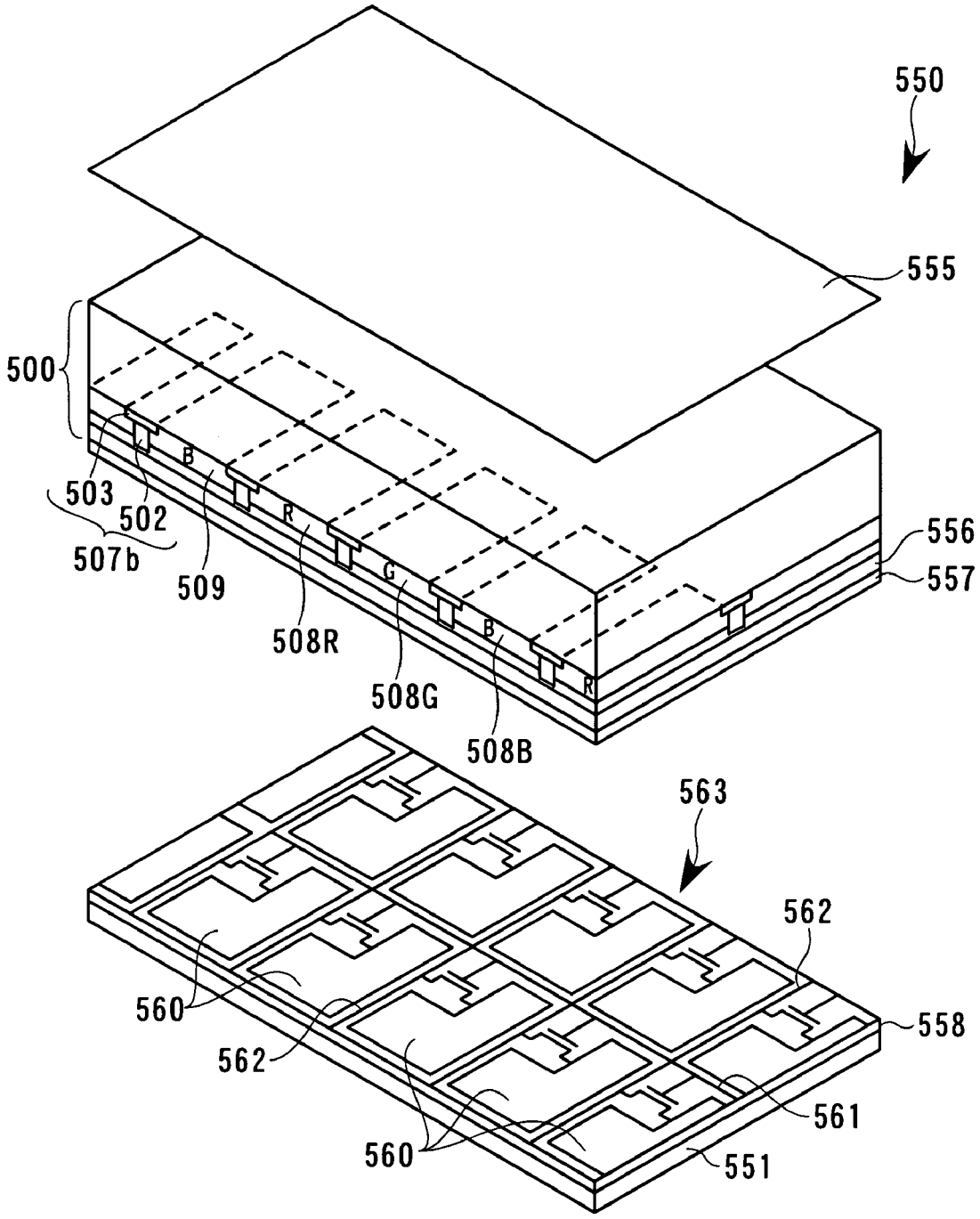
FIG. 20 is an exploded perspective view showing a schematic constitution of a liquid crystal device of a third example using the color filter to which this invention is applied.

FIG. 20 shows a third example in which a liquid crystal device is configured by using a color filter 500 to which this invention is applied and is an exploded perspective view showing a schematic constitution of a transparent TFT (thin film transistor) liquid crystal display.

In this liquid crystal device 550, the color filter 500 is disposed at the upper side in the drawing (the observer side).

This liquid crystal device 550 has a schematic constitution including: the color filter 500; a counter substrate 551 disposed so as to face the color filter 500; an unillustrated liquid crystal layer sandwiched by the color filter 500 and the counter substrate 551; a polarizer 555 disposed on an upper surface (the observer side) of the color filter 500; and a polarizer (not illustrated) disposed on a lower surface of the counter substrate 551.

On a surface of the protection film 509 of the color filter 500 (a surface at the counter substrate 551 side), an electrode 556 for driving liquid crystal is formed. This electrode 556 is made of a transparent conductive material such as ITO and becomes an overall electrode covering the entire region where a pixel electrode 560 to be described later is formed. Moreover, an alignment film 557 is provided in a state of covering a surface opposite to the pixel electrode 560 of the electrode 556.

On a surface of the counter substrate 551, the surface facing the color filter 500, an insulation layer 558 is formed. On this insulation layer 558, a scan line 561 and a signal line 562 are formed to be orthogonal to each other. In a region surrounded by these scan line 561 and signal line 562, the pixel electrode 560 is formed. Note that, in an actual liquid crystal device, an alignment layer is provided on the pixel electrode 560. However, description thereof is omitted in the drawing.

Moreover, in a notched part of the pixel electrode 560 and the portion surrounded by the scan line 561 and the signal line 562, a thin film transistor 563 including a source electrode, a drain electrode, a semiconductor and a gate electrode is installed. The thin film transistor 563 is turned on and off by application of a signal to the scan line 561 and the signal line 562. Thus, conduction to the pixel electrode 560 can be controlled.

The above-described liquid crystal devices 520, 530 and 550 of the respective examples shown above are the transparent liquid crystal device. However, a reflective liquid crystal device or a translucent reflective liquid crystal device can be obtained by providing a reflective layer or a translucent reflective layer.

Figure 21:
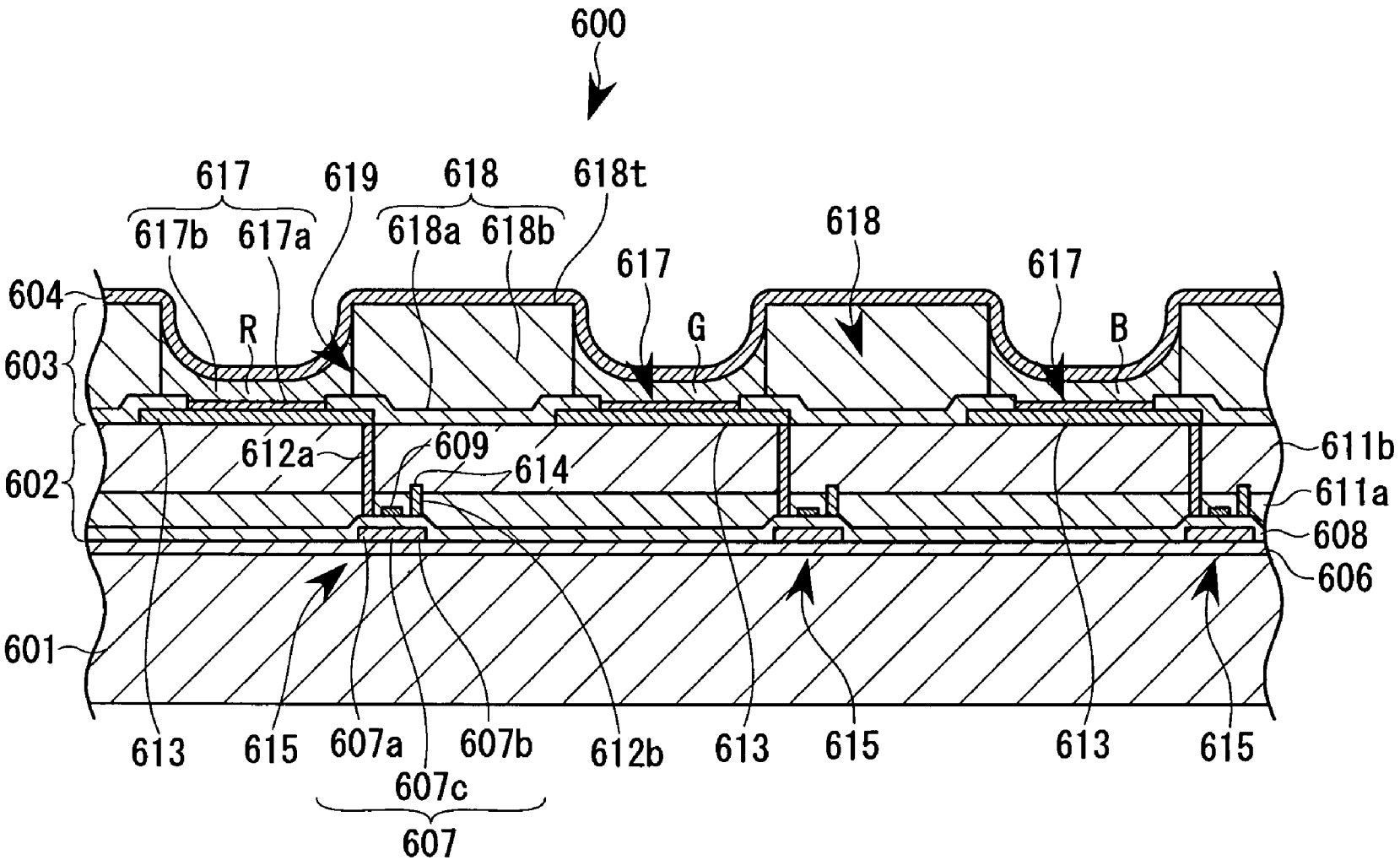
FIG. 21 is a cross-sectional view of a main part of a display device that is an organic EL device.

Next, FIG. 21 is a cross-sectional view of a main part of a display region of an organic EL device (hereinafter simply referred to as a display device 600).

This display device 600 is schematically constituted in a state where a circuit element part 602, an emitting element part 603 and a cathode 604 are laminated on a substrate (W) 601.

In this display device 600, light emitted from the emitting element part 603 to the substrate 601 side is transmitted through the circuit element part 602 and the substrate 601 and is outputted to the observer side. Meanwhile, light emitted from the emitting element part 603 to the opposite side of the substrate 601 is reflected by the cathode 604 before being transmitted through the circuit element part 602 and the substrate 601 and outputted to the observer side.

An underlayer protection film 606 made of a silicon oxide film is formed between the circuit element part 602 and the substrate 601. On this underlayer protection film 606 (the emitting element part 603 side), an island-shaped semiconductor film 607 made of polysilicon is formed. In regions on the right and left sides of the semiconductor film 607, a source region 607*a* and a drain region 607*b* are formed by high-concentration positive ion implantation, respectively. A center portion of the semiconductor film 607, in which no positive ion is implanted, becomes a channel region 607*c*.

Moreover, in the circuit element part 602, a transparent gate insulation film 608 covering the underlayer protection film 606 and the semiconductor film 607 is formed. In a position corresponding to the channel region 607*c* of the semiconductor film 607 on the gate insulation film 608, a gate electrode 609 made of Al, Mo, Ta, Ti, W or the like, for example, is formed. On the gate electrode 609 and the gate insulation film 608, transparent first and second interlayer insulation films 611*a* and 611*b* are formed. Moreover, by penetrating the first and second interlayer insulation films 611*a* and 611*b*, contact holes 612*a* and 612*b* communicating with the source and drain regions 607*a* and 607*b* of the semiconductor film 607, respectively, are formed.

On the second interlayer insulation film 611*b*, a transparent pixel electrode 613 made of ITO or the like is formed by being patterned in a predetermined shape. This pixel electrode 613 is connected to the source region 607*a* through the contact hole 612*a*.

Moreover, a power source line 614 is disposed on the first interlayer insulation film 611*a* and this power source line 614 is connected to the drain region 607*b* through the contact hole 612*b*.

As described above, in the circuit element part 602, thin film transistors 615 for drive are formed, which are connected to the respective pixel electrodes 613.

The above-described emitting element part 603 has a schematic constitution including: functional layers 617 laminated on the plurality of pixel electrodes 613, respectively; and bank parts 618 which are provided between the respective pixel electrodes 613 and functional layers 617 and separate the respective functional layers 617 from each other.

The emitting element includes these pixel electrodes 613, the functional layers 617 and the cathode 604 disposed on the functional layers 617. Note that the pixel electrode 613 is formed by being patterned in an approximately rectangular shape when viewed from the front and the bank parts 618 are formed between the respective pixel electrodes 613.

Each of the bank parts 618 includes: an inorganic bank layer 618*a* (a first bank layer) formed by using an inorganic material such as SiO, $SiO_2$ and $TiO_2$, for example; and an organic bank layer 618*b* (a second bank layer) with a trapezoidal cross-section, which is laminated on the inorganic bank layer 618*a* and is formed by using resist excellent in resistances to heat and solvents such as acrylic resin and polyimide resin. A part of this bank part 618 is formed in a state of running on a peripheral portion of the pixel electrode 613.

Between the respective bank parts 618, opening portions 619 gradually opened upward to the pixel electrodes 613 are formed.

The above-described functional layer 617 includes: a hole injection/transport layer 617*a* formed in a state of being laminated on the pixel electrode 613 in the opening portion 619; and an emitting layer 617*b* formed on the hole injection/transport layer 617*a*. Note that another functional layer which has another function may be further formed adjacent to this emitting layer 617*b*. For example, it is also possible to form an electron transport layer.

The hole injection/transport layer 617*a* has a function of transporting positive holes from the pixel electrode 613 side and injecting the positive holes into the emitting layer 617*b*. This hole injection/transport layer 617*a* is formed by ejecting a first composition (a function liquid) including a hole injection/transport layer forming material. As the hole injection/transport layer forming material, for example, a polythiophene derivative such as polyethylenedioxythiophene and a mixture such as polystyrene sulfonate are used.

The emitting layer 617*b* emits light in red (R), green (G) or blue (B) and is formed by ejecting a second composition (a function liquid) including an emitting layer forming material (an emitting material). As a solvent (a nonpolar solvent) of the second composition, one which is does not melt the hole injection/transport layer 617*a* is preferable and cyclohexylbenzene, dihydrobenzofuran, trimethylbenzene, tetramethylbenzene or the like can be used, for example. By using such a nonpolar solvent as the second composition of the emitting layer 617*b*, the emitting layer 617*b* can be formed without remelting the hole injection/transport layer 617*a* again.

In the emitting layer 617*b*, the positive holes injected from the hole injection/transport layer 617*a* are recombined with electrons injected from the cathode 604 at the emitting layer and thus light is emitted.

The cathode 604 is formed in a state of covering the entire surface of the emitting element part 603 and plays a role of applying a current to the functional layer 617 by being paired up with the pixel electrode 613. Note that an unillustrated sealing member is disposed on this cathode 604.

Next, with reference to FIGS. 22 to 30, steps of manufacturing the above-described display device 600 will be described.

Figure 22:
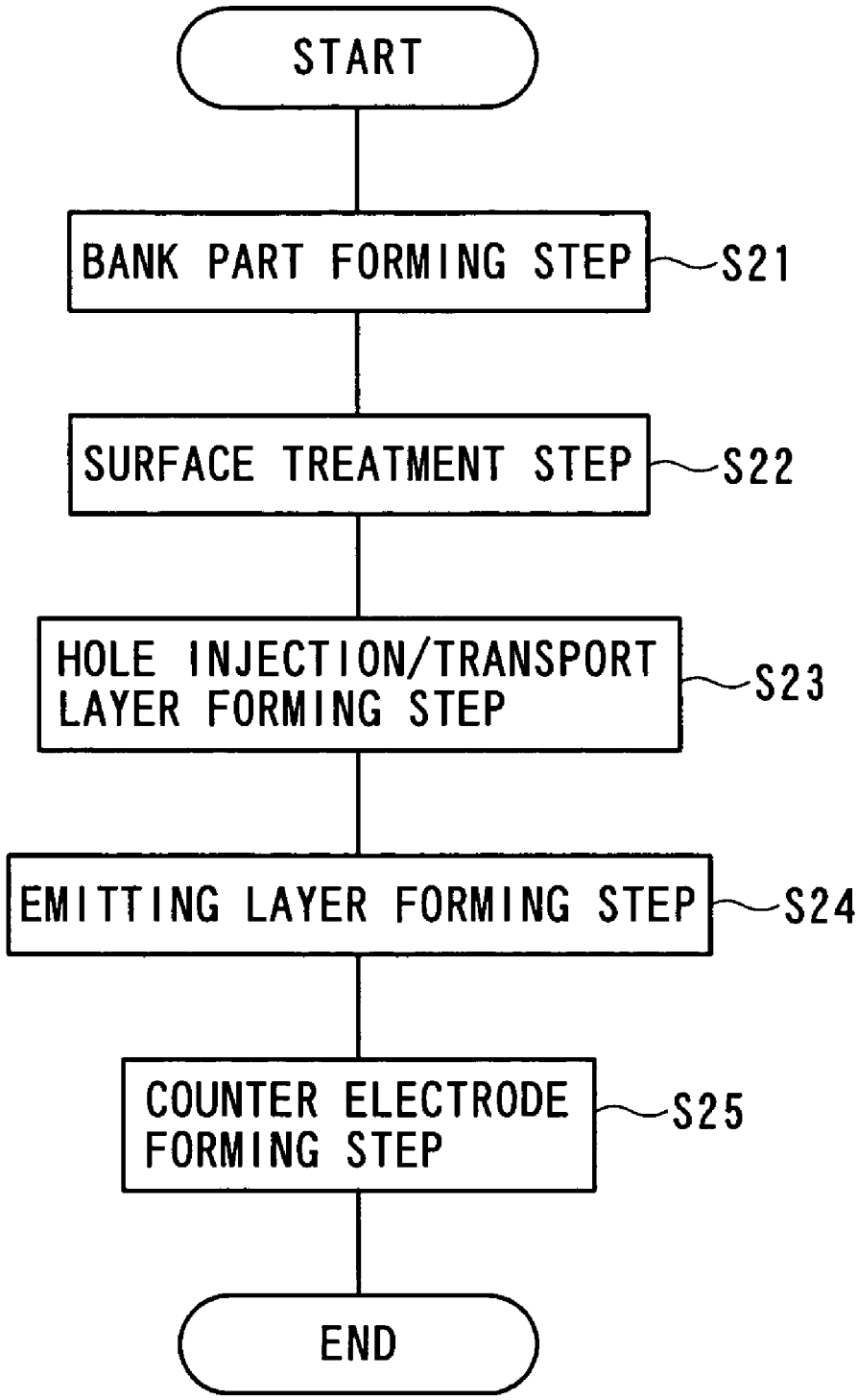
FIG. 22 is a flowchart explaining steps of manufacturing the display device that is the organic EL device.

As shown in FIG. 22, the display device 600 is manufactured through a bank part formation step (S21), a surface treatment step (S22), a hole injection/transport layer formation step (S23), an emitting layer formation step (S24) and a counter electrode formation step (S25). Note that the manufacturing steps are not limited to those described above as an example. As the need arises, any of the steps may be removed therefrom and, alternatively, another step may be added thereto.

Figure 23:
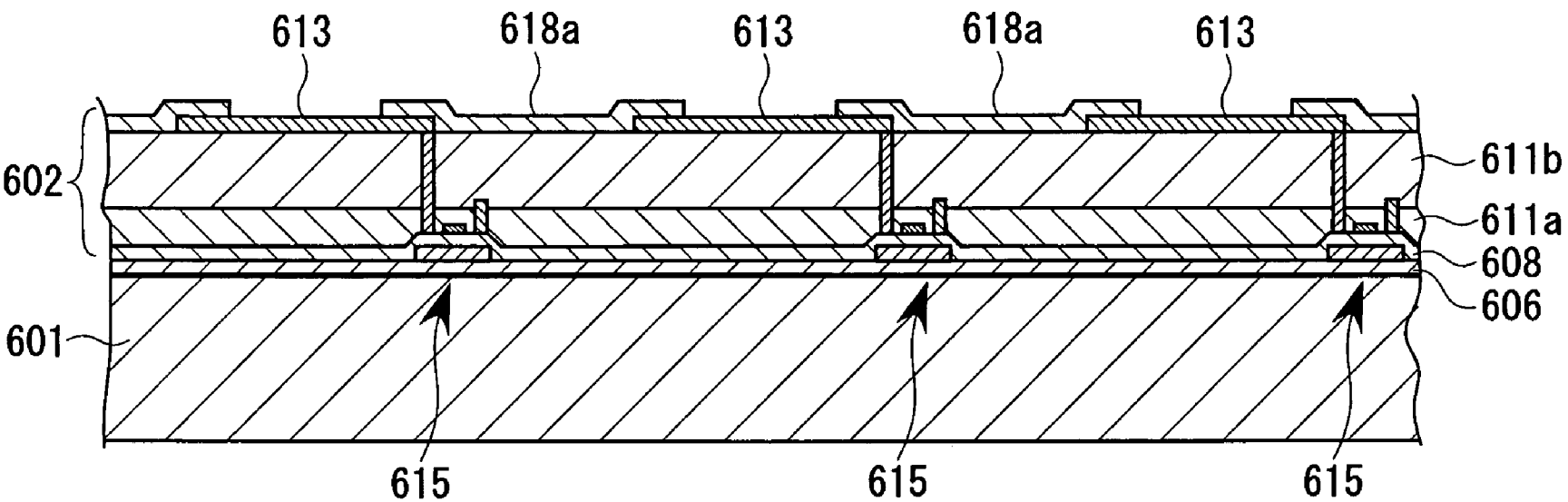
FIG. 23 is a view explaining a step of forming an inorganic bank layer.

First, in the bank part formation step (S21), as shown in FIG. 23, the inorganic bank layer 618*a* is formed on the second interlayer insulation film 611*b*. This inorganic bank layer 618*a* is formed by forming an inorganic film in a formation position thereof and, thereafter, patterning this inorganic film by using a photolithography technology or the like. In this case, a part of the inorganic bank layer 618*a* is formed so as to overlap with the peripheral portion of the pixel electrode 613.

Figure 24:
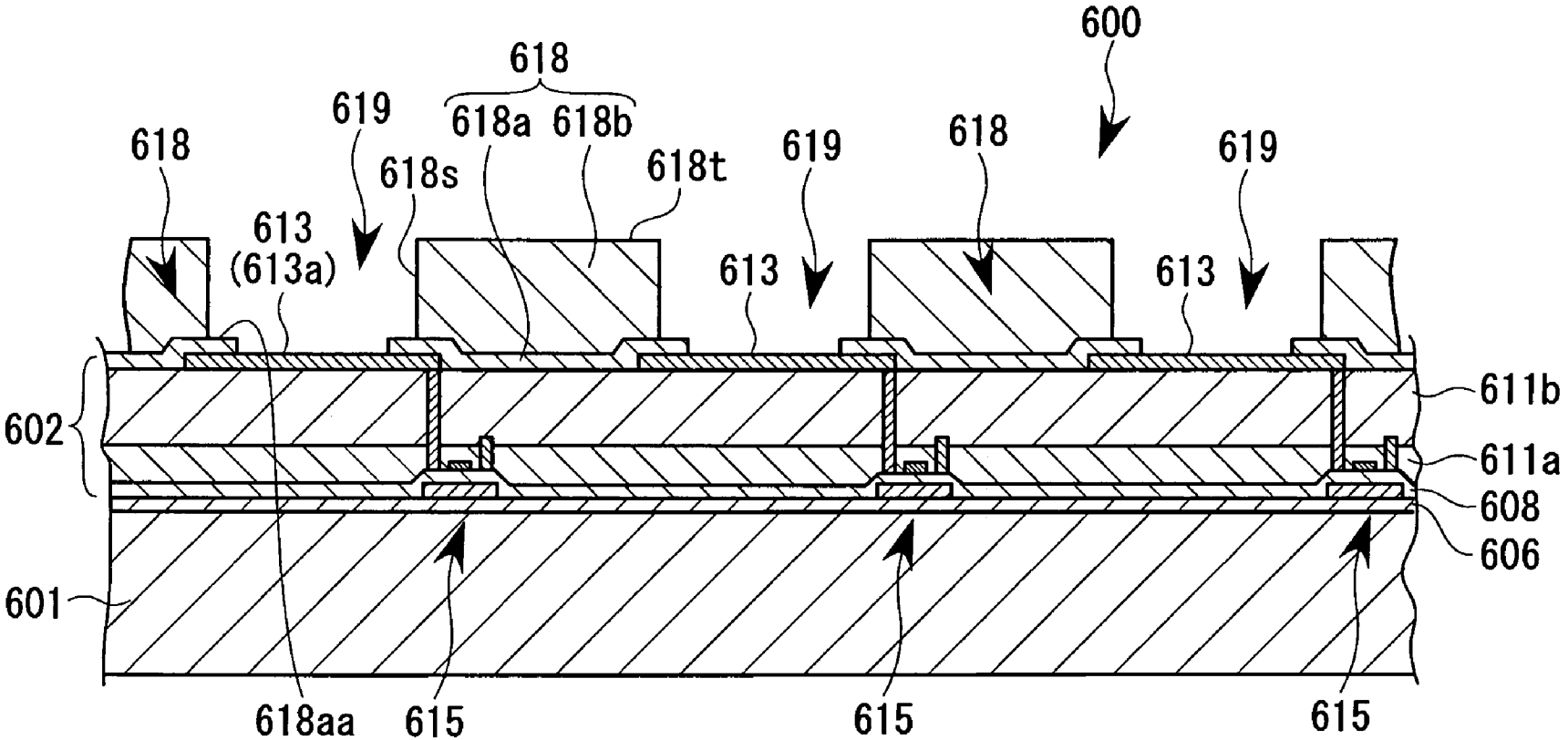
FIG. 24 is a view explaining a step of forming an organic bank layer.

Once the inorganic bank layer 618*a* is formed, as shown in FIG. 24, the organic bank layer 618*b* is formed on the inorganic bank layer 618*a*. This organic bank layer 618*b* is also formed by being patterned by using the photolithography technology or the like similarly to the inorganic bank layer 618*a*.

In such a manner, the bank part 618 is formed. Moreover, along with the formation of the bank parts 618, the opening portions 619 made open upward to the pixel electrodes 613 are formed between the respective bank parts 618. These opening portions 619 define pixel regions.

In the surface treatment step (S22), a lyophilic treatment and a liquid repellency treatment are performed. Regions subjected to the lyophilice treatment include a first lamination part 618*aa* of the inorganic bank layer 618*a* and an electrode surface 613*a* of the pixel electrode 613. These regions are subjected to the surface treatment and are made lyophilic by performing plasma processing using oxygen as processing gas, for example. This plasma processing also serves as cleaning of ITO that is the pixel electrode 613, and the like.

Moreover, the liquid repellency treatment is performed on a wall surface 618*s* of the organic bank layer 618*b* and an upper surface 618*t* thereof. Surfaces of the wall surface 618*s* and the upper surface 618*t* are fluorinated (are made liquid repellent) by performing plasma processing using methane tetrafluoride as processing gas, for example.

By performing the above-described surface treatment step, the function liquid can be more surely ejected into the pixel regions in forming the functional layer 617 by using the liquid droplet ejection heads 31. Moreover, it is made possible to prevent the function liquid ejected into the pixel regions from overflowing from the opening portions 619.

Through the above-described steps, the display device substrate 600A is obtained. This display device substrate 600A is mounted on the suction table 71 of the imaging apparatus 1 shown in FIG. 1 and the hole injection/transport layer formation step (S23) and the emitting layer formation step (S24) are performed, which will be described below.

Figure 25:
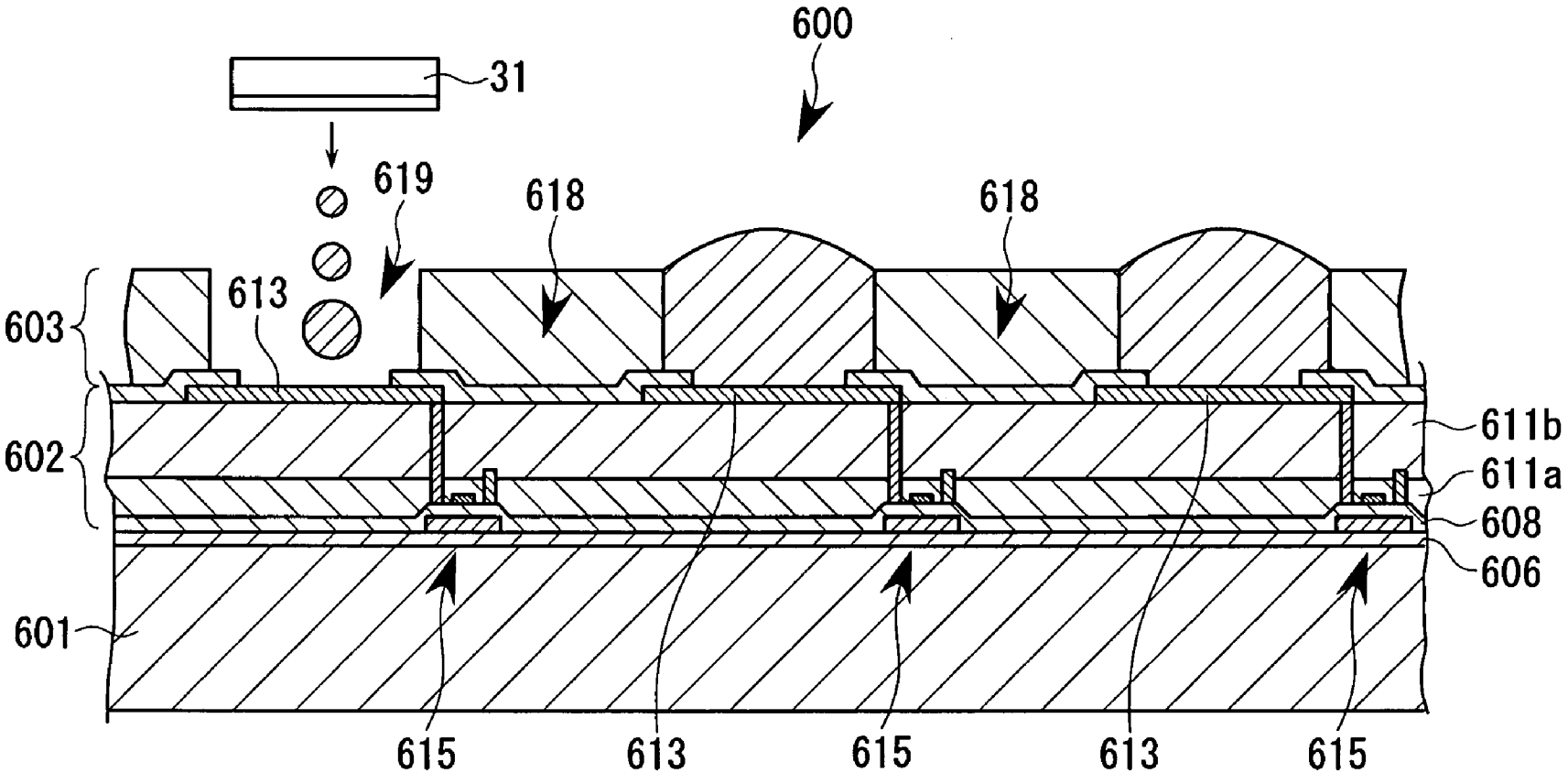
FIG. 25 is a view explaining a process of forming a hole injection/transport layer.
Figure 26:
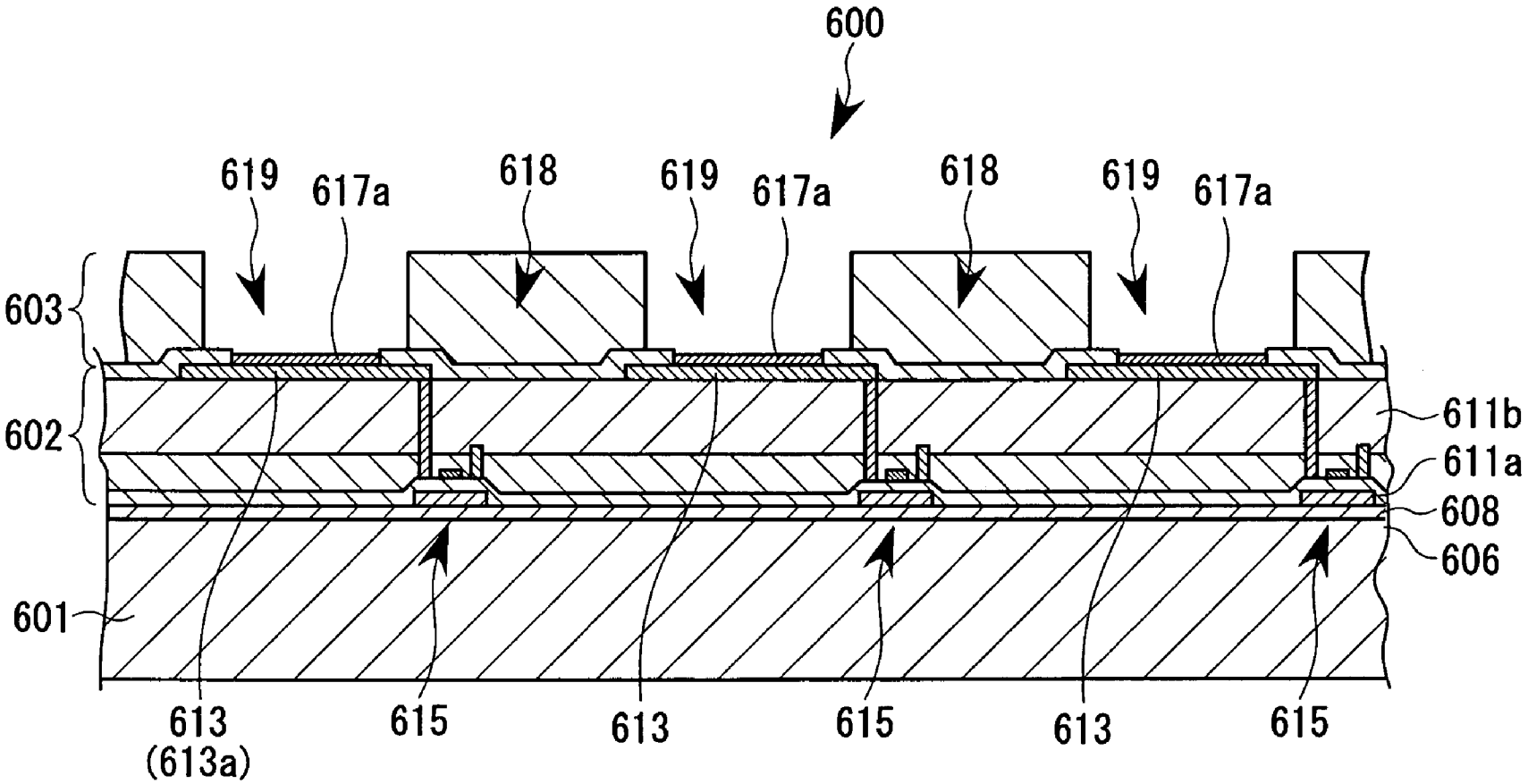
FIG. 26 is a view explaining a state where the hole injection/transport layer is formed.

As shown in FIG. 25, in the hole injection/transport layer formation step (S23), the first composition including the hole injection/transport layer forming material is ejected into each of the opening portions 619, that is the pixel region, from the liquid droplet ejection head 31. Thereafter, as shown in FIG. 26, a drying treatment and a heat treatment are performed to evaporate a polar solvent contained in the first composition and thus the hole injection/transport layer 617*a* is formed on the pixel electrode 613 (the electrode surface 613*a*).

Next, the emitting layer formation step (S24) will be described. In this emitting layer formation step, as described above, in order to prevent the remelting of the hole injection/transport layer 617*a*, a nonpolar solvent insoluble in the hole injection/transport layer 617*a* is used as a solvent of the second composition used in forming the emitting layer.

However, since the hole injection/transport layer 617*a* has a low affinity to the nonpolar solvent, even if the second composition containing the nonpolar solvent is ejected on the hole injection/transport layer 617*a*, there is a risk that the hole injection/transport layer 617*a* and the emitting layer 617*b* cannot be adhered together or that the emitting layer 617*b* cannot be evenly applied.

Consequently, in order to improve the affinity of the surface of the hole injection/transport layer 617*a* for the nonpolar solvent and the emitting layer forming material, it is preferable to perform a surface treatment (a surface modification treatment) before forming the emitting layer. This surface treatment is performed in such a manner that a surface modifying material, which is the same as the nonpolar solvent of the second composition used in the formation of the emitting layer or a solvent similar to the nonpolar solvent, is applied onto the hole injection/transport layer 617*a* and this surface modifying material is dried.

By performing the treatment as described above, the surface of the hole injection/transport layer 617*a* is likely to adapt to the nonpolar solvent and, in the following step, the second composition containing the emitting layer forming material can be evenly applied to the hole injection/transport layer 617*a*.

Figure 27:
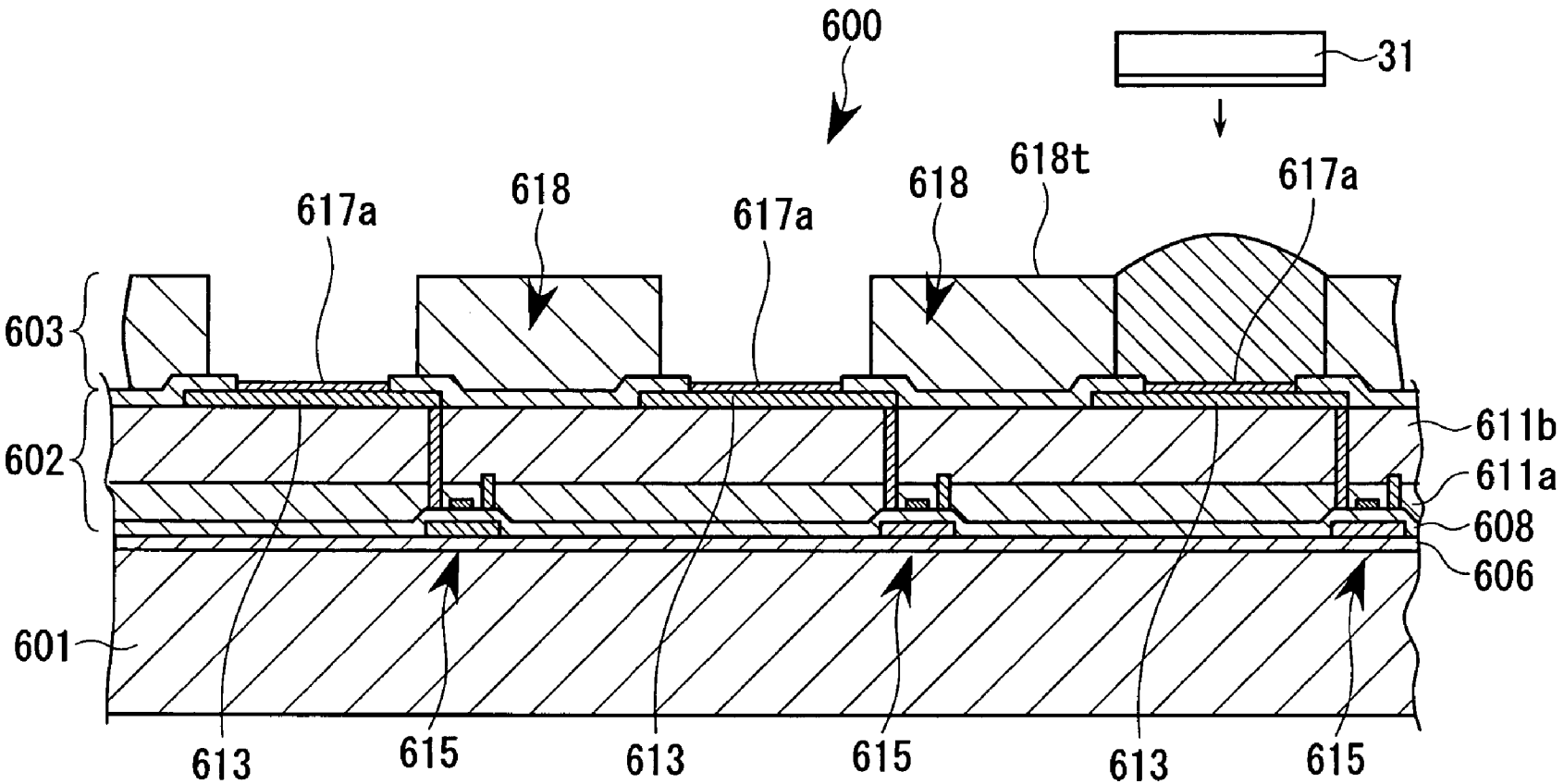
FIG. 27 is a view explaining a process of forming a blue emitting layer.

Next, as shown in FIG. 27, as the function liquid, the second composition containing an emitting layer forming material corresponding to any of the three colors (blue (B) in the example of FIG. 27) is implanted for a predetermined amount into the pixel region (the opening portion 619). The opening portion 619 is filled with the second composition implanted into the pixel region, the second composition spreading above the hole injection/transport layer 617*a*. Note that, if the second composition is ejected off the pixel region and on the upper surface 618*t* of the bank part 618 by any chance, the upper surface 618*t* is subjected to the liquid repellency treatment as described above. Thus, the second composition is likely to tumble into the opening portion 619.

Figure 28:
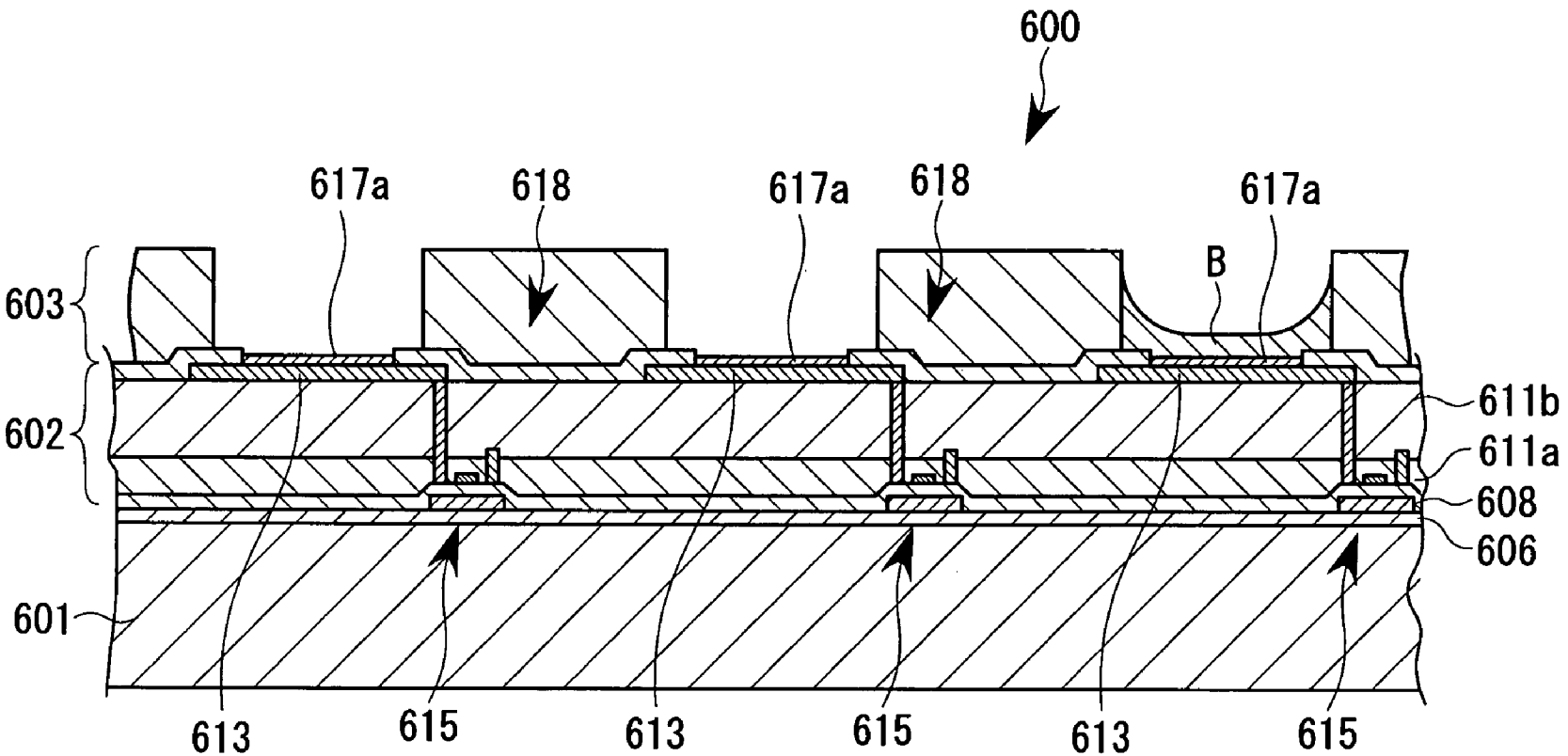
FIG. 28 is a view explaining a state where the blue emitting layer is formed.
Figure 29:
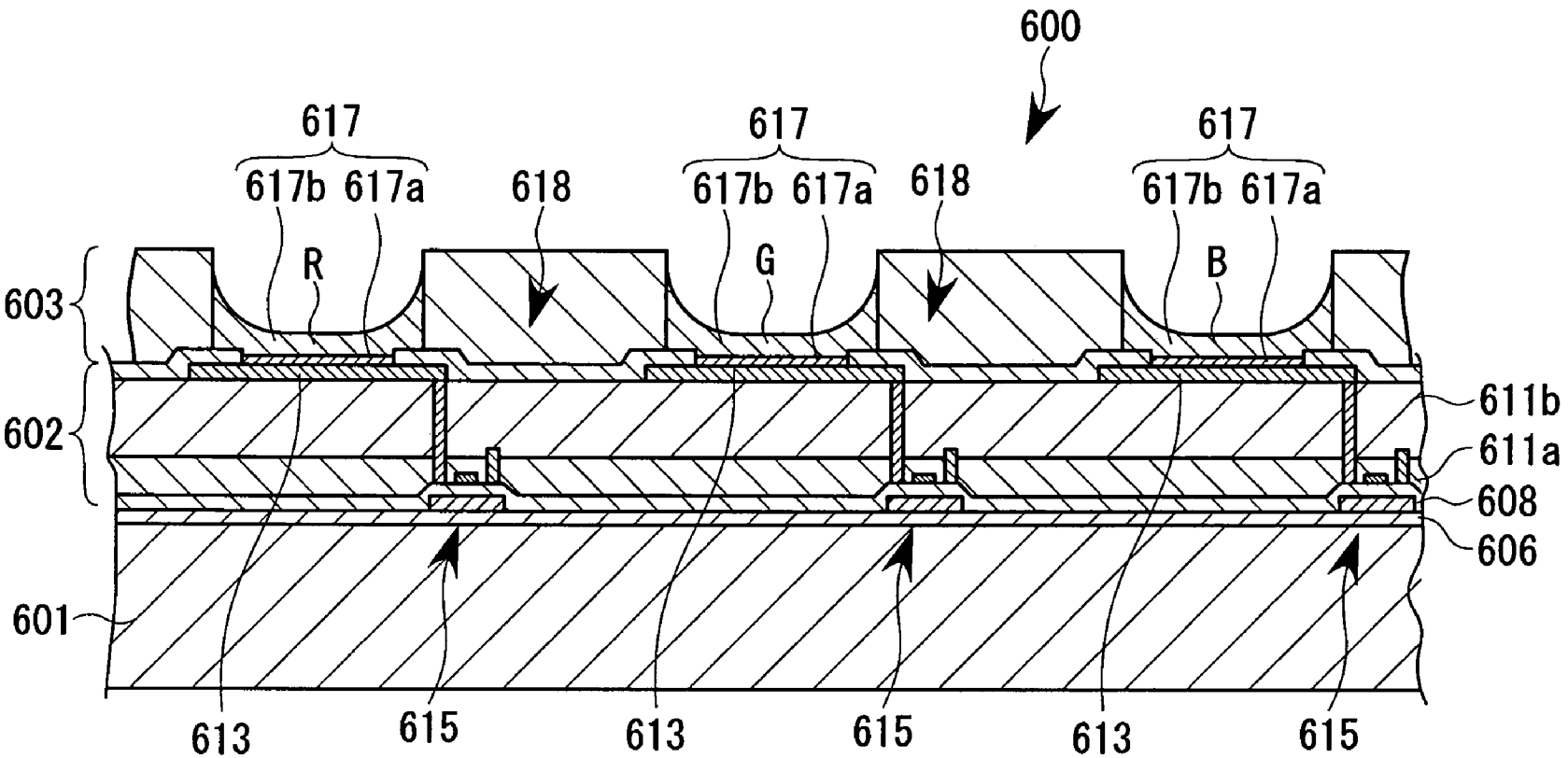
FIG. 29 is a view explaining a state where emitting layers of every color are formed.

Thereafter, by performing a drying step and the like, the second composition after being ejected is dried to evaporate the nonpolar solvent contained in the second composition. Thus, as shown in FIG. 28, the emitting layer 617*b* is formed on the hole injection/transport layer 617*a*. In the case of this drawing, the emitting layer 617*b* corresponding to blue (B) is formed.

Similarly, by using the liquid droplet ejection heads 31, steps similar to that of the emitting layer 617*b* corresponding to blue (B) described above are sequentially performed as shown in FIG. 29. Thus, the emitting layers 617*b* corresponding to the other colors (red (R) and green (G)) are formed. Note that the order of forming the emitting layers 617*b* is not limited to that shown as an example but the emitting layers 617*b* may be formed in any order. For example, it is also possible to determine the order of formation in accordance with the emitting layer formation material. Moreover, as an arrangement pattern of the three colors R, G and B, there are stripe arrangement, mosaic arrangement, delta arrangement and the like.

As described above, the functional layer 617, that is, the hole injection/transport layer 617*a* and the emitting layer 617*b*, are formed on the pixel electrode 613. Thereafter, the processing moves to the counter electrode formation step (S25).

Figure 30:
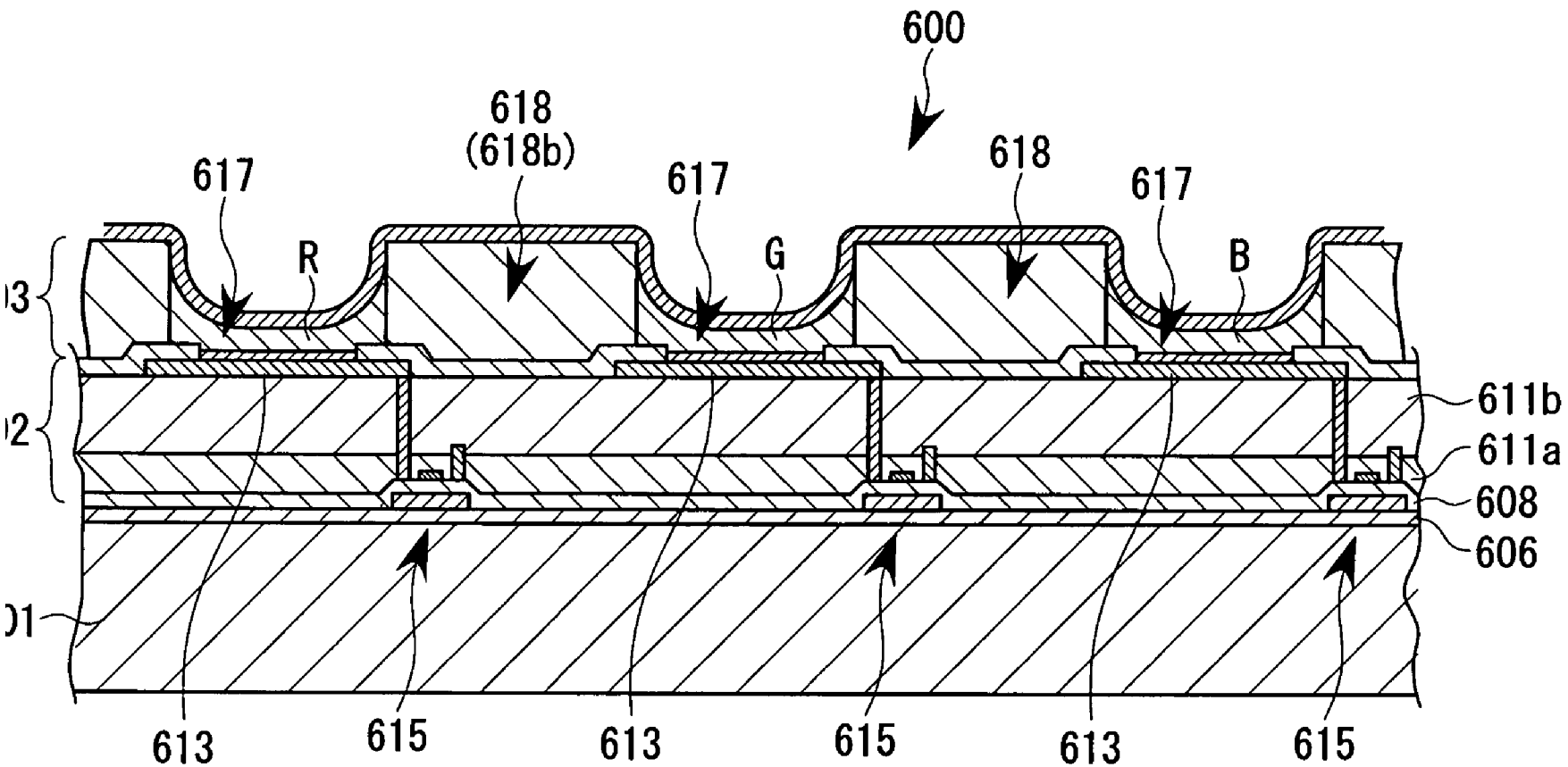
FIG. 30 is a view explaining a step of forming a cathode.

In the counter electrode formation step (S25), as shown in FIG. 30, the cathode 604 (the counter electrode) is formed on the entire surfaces of the emitting layer 617*b* and the organic bank layer 618*b* by using, for example, a deposition method, a sputtering method, a CVD method or the like. In the embodiment, this cathode 604 is formed by laminating a calcium layer and an aluminum layer, for example.

In an upper portion of this cathode 604, an Al film or an Ag film as an electrode and a protection layer such as $SiO_2$ and SiN for preventing oxidization thereof are accordingly provided.

After the cathode 604 is formed as described above, the upper portion of the cathode 604 is subjected to other processing such as sealing processing of sealing by using a sealing member and wiring processing. Thus, the display device 600 is obtained.

Figure 31:
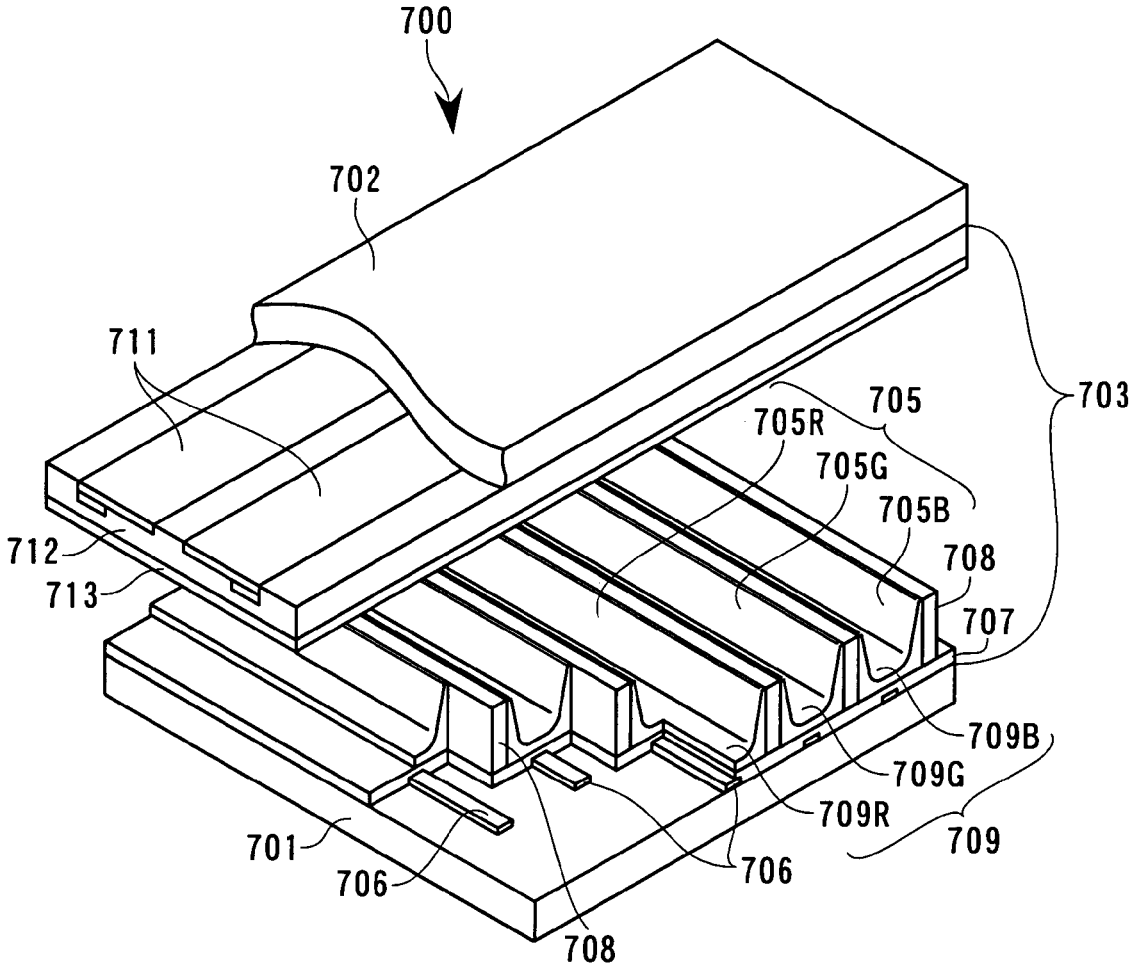
FIG. 31 is an exploded perspective view of a main part of a display device that is a plasma display panel (PDP) device.

Next, FIG. 31 is an exploded perspective view of a main part of a plasma display panel device (a PDP device; hereinafter simply referred to as a display device 700). Note that, in FIG. 31, the display device 700 is shown in a state of being partially notched.

This display device 700 has a schematic constitution including: first and second substrates 701 and 702, which are disposed while facing each other; and a discharge display unit 703 formed between the substrates. The discharge display unit 703 includes a plurality of discharge chambers 705. Three discharge chambers 705 including a red discharge chamber 705R, a green discharge chamber 705G and a blue discharge chamber 705B among the plurality of discharge chambers 705 are disposed as a set to form one pixel.

On an upper surface of the first substrate 701, address electrodes 706 are formed in a striped manner with predetermined intervals therebetween. A dielectric layer 707 is formed so as to cover these address electrodes 706 and the upper surface of the first substrate 701. On the dielectric layer 707, partitions 708 are provided upright so as to be positioned between and along the respective address electrodes 706. These partitions 708 include the ones extending on the both sides in the width direction of the address electrodes 706 as shown in FIG. 31 and unillustrated ones extending in a direction orthogonal to the address electrodes 706.

Consequently, regions separated by these partitions 708 are the discharge chambers 705.

In the discharge chambers 705, phosphors 709 are disposed. The phosphors 709 emit fluorescent light of red (R), green (G) and blue (B). A red phosphor 709R, a green phosphor 709G and a blue phosphor 709B are disposed at bottoms of the red, green and blue discharge chambers 705R, 705G and 705B, respectively.

On a lower surface of the second substrate 702 in FIG. 31, a plurality of display electrodes 711 are formed in a striped manner at predetermined intervals in a direction orthogonal to the above-described address electrodes 706. A dielectric layer 712 and a protection film 713 made of MgO and the like are formed so as to cover the display electrodes and the lower surface of the second substrate 702.

The first and second substrates 701 and 702 are attached to each other while facing each other in a state where the address electrodes 706 and the display electrodes 711 are orthogonal to each other. Note that the foregoing address electrodes 706 and the display electrodes 711 are connected to an alternator (not illustrated).

By conducting electricity through the respective electrodes 706 and 711, phosphors 709 are excited to emit light in the discharge display unit 703. Thus, color display is realized.

In the embodiment, the above-described address electrodes 706, display electrodes 711 and phosphors 709 can be formed by using the imaging apparatus 1 shown in FIG. 1. The steps of forming the address electrodes 706 in the first substrate 701 will be described below as an example.

In this case, in a state where the first substrate 701 is placed on the suction table 71 of the imaging apparatus 1, the following steps are performed.

First, by using the liquid droplet ejection heads 31, a liquid material (a function liquid) containing a conductive film wiring forming material is ejected as a function liquid to an address electrode formation region. This liquid material is one obtained by dispersing conductive particles such as metal in a dispersion medium as the conductive film wiring forming material. As the conductive particles, metal particles containing gold, silver, copper, palladium, nickel or the like, conductive polymer and the like are used.

When the filling of the liquid material is finished for all the address electrode formation regions to be the target of the filling, the liquid material after being ejected is dried to evaporate the dispersion medium contained in the liquid material. Thus, the address electrodes 706 are formed.

Incidentally, the formation of the address electrodes 706 is described above as an example. The foregoing display electrodes 711 and phosphors 709 can be also formed through the steps described above.

In the case of forming the display electrodes 711, similarly to the case of the address electrodes 706, a liquid material (a function liquid) containing a conductive film wiring forming material is ejected as a function liquid to display electrode formation regions.

Moreover, in the case of forming the phosphors 709, a liquid material (a function liquid) containing fluorescent materials corresponding to the respective colors (R, G and B) is ejected as liquid droplets from the liquid droplet ejection heads 31 into the discharge chambers 705 of the corresponding colors.

Figure 32:
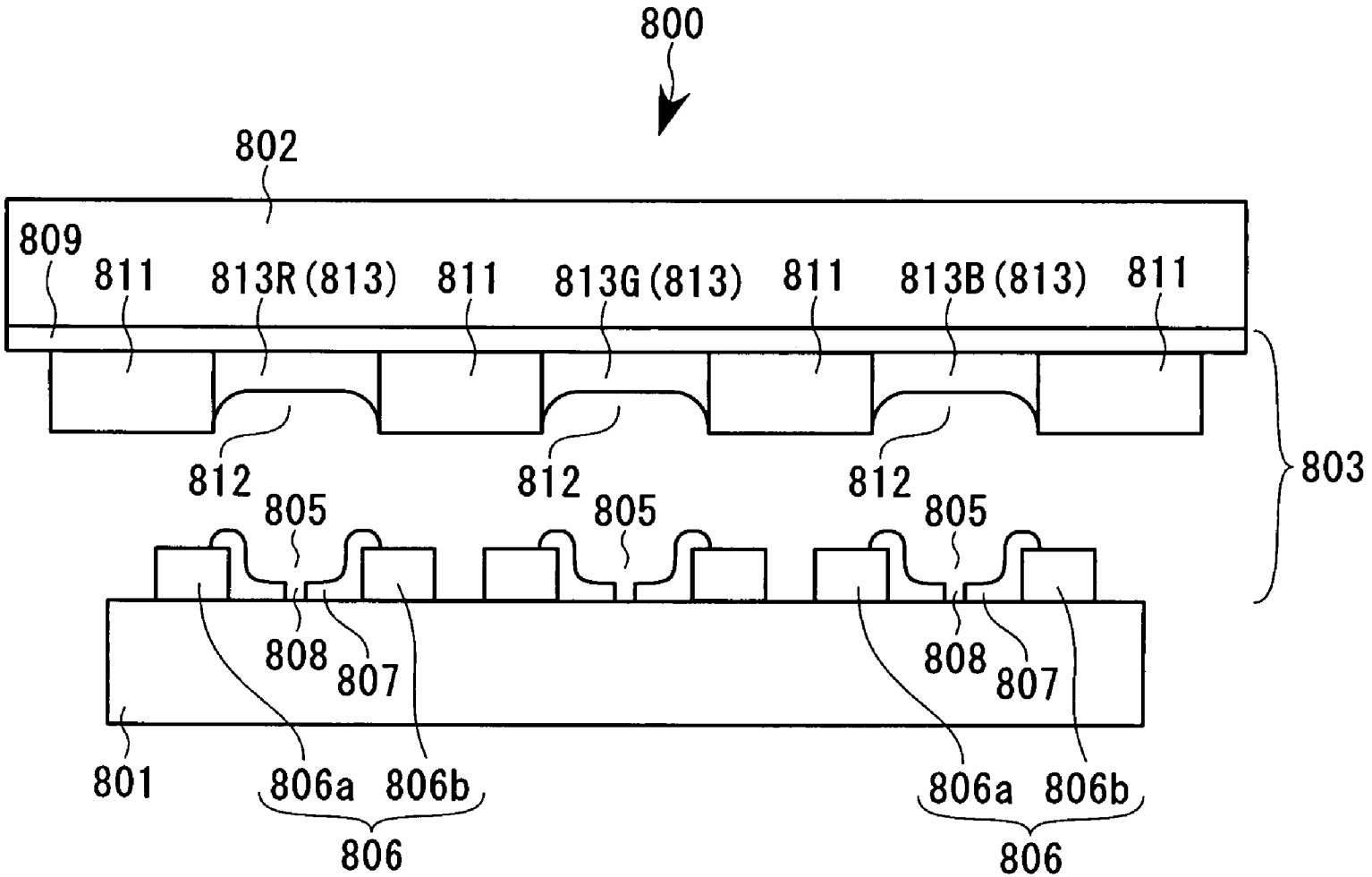
FIG. 32 is a cross-sectional view of a main part of a display device that is an electron-emitting device (an FED device)

Next, FIG. 32 is a cross-sectional view of a main part of an electron-emitting device (an FED device: hereinafter simply referred to as a display device 800). Note that, in FIG. 32, a cross-section of a part of the display device 800 is shown.

This display device 800 has a schematic constitution including: first and second substrates 801 and 802, which are disposed while facing each other; and a field-emission display unit 803 formed between the substrates. The field-emission display unit 803 includes a plurality of electron-emitting parts 805 disposed in a matrix manner.

On an upper surface of the first substrate 801, first and second element electrodes 806*a* and 806*b* included in cathode electrodes 806 are formed so as to be orthogonal to each other. Moreover, in portions separated by the first and second element electrodes 806*a* and 806*b*, conductive films 807 having gaps 808 formed therein are formed. Specifically, by using the first and second element electrodes 806*a* and 806*b* and the conductive films 807, the plurality of electron-emitting parts 805 are formed. The conductive film 807 is formed by using, for example, palladium oxide (PdO) or the like and the gap 808 is formed by forming or the like after the conductive film 807 has been deposited.

On a lower surface of the second substrate 802, an anode electrode 809 opposite to the cathode electrodes 806 is formed. On a lower surface of the anode electrode 809, grid-like bank parts 811 are formed. In respective downward opening portions 812 surrounded by the bank parts 811, phosphors 813 are disposed so as to correspond to the electron-emitting parts 805. The phosphors 813 emit fluorescent light of red (R), green (G) and blue (B). In the respective opening portions 812, a red phosphor 813R, a green phosphor 813G and a blue phosphor 813B are disposed in the predetermined pattern described above.

Accordingly, the first and second substrates 801 and 802 thus formed are attached to each other with a minute gap therebetween. In this display device 800, electrons jumping out of the first or second element electrode 806*a* or 806*b*, which are cathodes, through the conductive film 807 (the gap 808) are hit against the phosphors 813 formed on the anode electrode 809 that is an anode and are excited to emit light. Thus, color display is enabled.

In this case, similar to the other embodiment, the first and second element electrodes 806*a* and 806*b*, the conductive film 807 and the anode electrode 809 can be formed by using the imaging apparatus 1. In addition, the phosphors 813R, 813G and 813B of the respective colors can be formed by using the imaging apparatus 1.

Figure 33A:
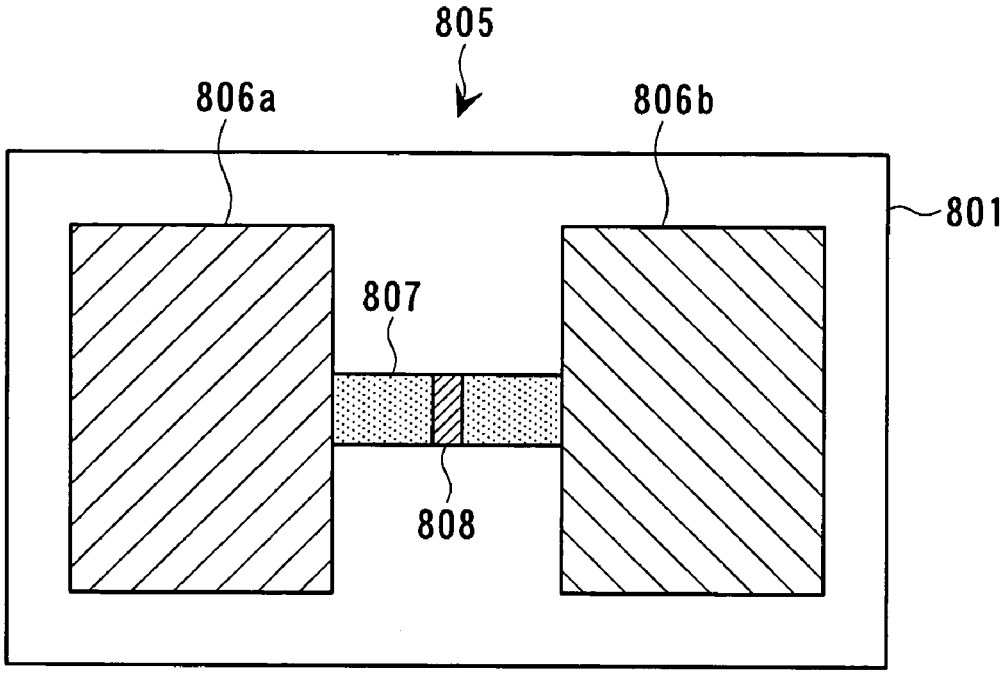
FIG. 33A is a plan view around an electron-emitting part of the display device and FIG. 33B is a plan view showing a method of forming the electron-emitting part.
Figure 33B:
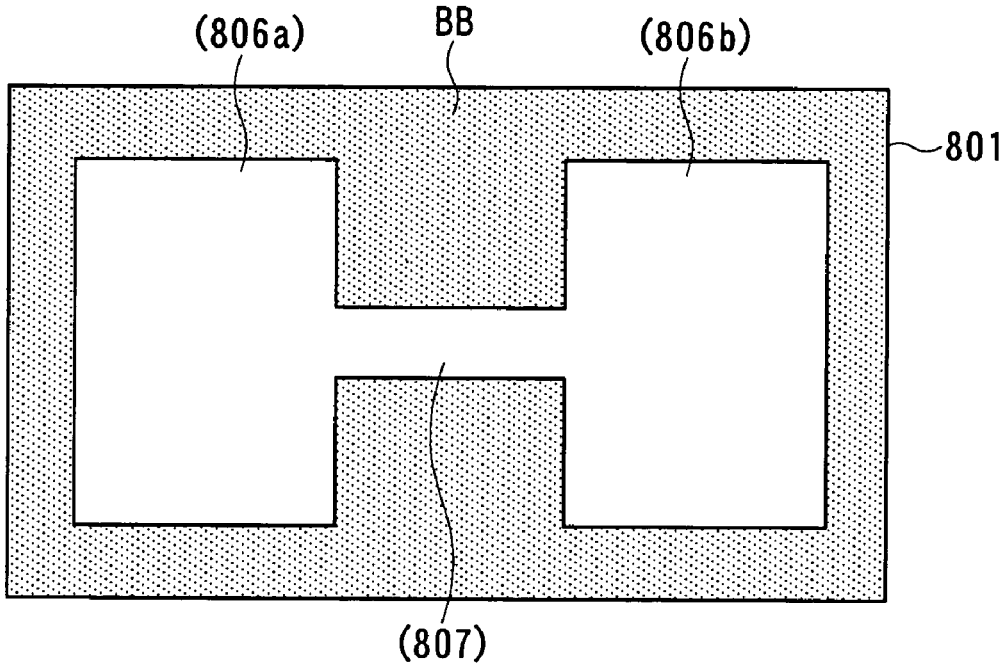

The first and second element electrodes 806*a* and 806*b* and the conductive film 807 have planar shapes shown in FIG. 33A. In the case of forming these electrodes and film, as shown in FIG. 33B, areas where the first and second element electrodes 806*a* and 806*b* and the conductive film 807 will be formed are previously left and a bank part BB is formed (by the photolithography method). Next, in a groove portion formed by the bank part BB, the first and second element electrodes 806*a* and 806*b* are formed (by an ink jet method using the imaging apparatus 1) and a solvent is dried to form a film. Thereafter, the conductive film 807 is formed (by the ink jet method using the imaging apparatus 1). Subsequently, after the conductive film 807 is deposited, the bank part BB is removed (by ashing) and the processing moves to the forming described above. Note that, similar to the case of the organic EL device described above, it is preferable to perform the lyophilic treatment for the first and second element electrodes 806*a* and 806*b* and to perform the liquid repellency treatment for the bank parts 811 and BB.

Moreover, as other electrooptic devices, devices for forming a metallic wiring, a lens, a resist, a light diffusion body and the like are conceivable. As described above, various function liquids may be introduced into the imaging apparatus 1. By using the foregoing imaging apparatus 1 for manufacturing various electrooptic devices, the function liquid supply pressure in the liquid droplet ejection heads can be maintained constant and the function liquid can be supplied surely to the liquid droplet ejection heads. In addition, it is possible to confirm in advance that all the ejection nozzles are normal. Thus, various devices can be manufactured efficiently without producing defectives.

As is apparent from the above description, according to this invention, only when the ejection of liquid droplets from the same ejection nozzle is determined to be abnormal twice in succession, the ejection nozzle is determined to be abnormal. Thus, the erroneous determination, in which the normal ejection nozzles are determined to be abnormal, can be prevented as much as possible. Furthermore, the ejection nozzle determined to be abnormal is restored by the maintenance operation. Thus, the imaging operation can be efficiently performed by using all the ejection nozzles and the productivity is improved.

By using the imaging apparatus, the electrooptic device, the method of manufacturing the electrooptic device and the electronic equipment according to this invention, reliability of the devices can be enhanced.

The entire disclosure of Japanese Patent Application Nos. 2002-328795 filed Nov. 12, 2002 and 2003-204393 filed Jul. 31, 2003 are incorporated by reference.

What is claimed is:

1. A method of determining abnormality of nozzles in an imaging apparatus having a plurality of ejection nozzles, comprising:

a first step of performing a function liquid droplet ejection confirming operation to determine whether or not function liquid droplets are normally ejected from the respective ejection nozzles by using liquid droplet detection means before performing the imaging operation;

a second step of performing the function liquid droplet ejection confirming operation once again, prior to performing a maintenance work, when the ejection of the function liquid droplets from any of said ejection nozzles is determined to be abnormal in the first step;

a third step of judging said ejection nozzle to be abnormal when the ejection of the function liquid droplets from an identical ejection nozzle is determined to be abnormal also in the second step;

a fourth step of performing the maintenance work when any of the ejection nozzles is judged to be abnormal, thereby restoring said ejection nozzles to a state in which the function liquid droplets are ejected normally;

a fifth step of performing the function liquid droplet ejection confirming operation once again after the fourth step; and a sixth step of transferring to the imaging work when the function liquid droplets are determined to be ejected normally from all of said ejection nozzles in the fifth step.

2. The method according to claim 1, wherein the maintenance operation is a preliminary ejection operation of ejecting the function liquid droplets from the ejection nozzles.

3. The method according to claim 2, further comprising:

a seventh step of performing the function liquid droplet ejection confirming operation once again after a second maintenance work to remove the function liquid droplets from said ejection nozzles when the function liquid droplet ejection is determined to be abnormal also in the fifth step; and an eighth step of issuing an instruction of replacing the head unit when the ejection of the function liquid droplets is determined to be abnormal even after the seventh step.

4. An imaging apparatus in which the method of determining abnormality of nozzles according to claim 1 is executed.

5. An electrooptic device having formed a film formation part by ejecting the function liquid droplets onto the workpiece from liquid droplet ejection heads with the imaging apparatus according to claim 4.

6. An electronic equipment having mounted thereon the electrooptic device according to claim 5.

7. A method of manufacturing an electrooptic device, comprising the step of forming a film formation part by ejecting the function liquid droplets onto the workpiece from liquid droplet ejection heads with the imaging apparatus according to claim 4.

8. An electronic equipment having mounted thereon the electrooptic device manufactured by the method of manufacturing an electrooptic device according to claim 7.

* * * * *